US005804364A

United States Patent [19]

Takehara

[11] Patent Number: 5,804,364

[45] Date of Patent: Sep. 8, 1998

[54] METHOD FOR PRODUCING FINE SILVER HALIDE EMULSION

[75] Inventor: Hiroshi Takehara, Minami-Ashigara, Japan

[73] Assignee: Fuji Photo Film Co., Ltd., Kanagawa, Japan

[21] Appl. No.: 649,274

[22] Filed: May 17, 1996

[30] Foreign Application Priority Data

May 17, 1995 [JP] Japan ..... 7-141370

[51] Int. Cl.[6] ..... G03C 1/005

[52] U.S. Cl. ..... 430/569; 430/568; 430/600; 430/613; 430/614

[58] Field of Search ..... 430/613, 614, 430/600, 214, 569, 568

[56] References Cited

U.S. PATENT DOCUMENTS

| | | | |
|---|---|---|---|
| 4,469,784 | 9/1984 | Heki et al. | 430/567 |
| 4,705,747 | 11/1987 | Klotzer et al. | 430/659 |
| 5,227,286 | 7/1993 | Kuno et al. | 430/539 |
| 5,556,741 | 9/1996 | Suga et al. | 430/569 |

FOREIGN PATENT DOCUMENTS 60-27563-A 2/1994 Japan .

*Primary Examiner*—Thorl Chea
*Attorney, Agent, or Firm*—Birch, Stewart, Kolasch & Birch, LLP

[57] ABSTRACT

A method for producing a silver halide emulsion containing silver halide grains having a mean grain size of 0.15 $\mu$m or less, wherein at least a part or the whole of a silver halide grain formation process is performed in the presence of an imidazole compound.

17 Claims, No Drawings

METHOD FOR PRODUCING FINE SILVER HALIDE EMULSION

FIELD OF THE INVENTION

The present invention relates to a method for producing a fine silver halide emulsion excellent in production stability and keeping quality.

BACKGROUND OF THE INVENTION

Silver halide photographic materials have come to be required to have various properties according to various uses thereof. Of these, some photographic materials require extreme granularity and sharpness, although they may be low in sensitivity, different from ordinary photographic materials.

It is known that a decrease in grain size improves granularity and sharpness. According to studies by the present inventors, however, small-sized grains have problems with regard to production stability and keeping quality, compared with large-sized grains.

Compared with grains having a usual size, small-sized grains having a grain size of 0.15 μm or less as in the present invention are liable to produce variations in photographic characteristics with changes in silver potential in grain forming procedures. It is therefore a great problem is stabilizing the photographic properties.

JP-A-58-54333 (the term "JP-A" as used herein means an "unexamined published Japanese patent application") (corresponding to U.S. Pat. No. 4,469,784) and JP-B-62-2301 (the term "JP-B" as used herein means an "examined Japanese patent publication") disclose the use of imidazole compounds as silver halide solvents at the time of grain growth. JP-A-61-205930 (corresponding to U.S. Pat. No. 4,757,747) discloses the use of imidazole compounds in combination with iridium. However, they are all silent on the problems with small-sized grains, having a grain size of 0.15 μm or less, as in the present invention.

Further, JP-A-6-27563 discloses that high-contrast emulsions high in sensitivity and excellent in granularity can be provided by use of imidazole compounds. However, this patent is also silent on the problem of small-sized grains. This patent discloses that the emulsions having the above-mentioned characteristics can be obtained by forming "perfect cubes" using the imidazole compounds. However, in the case of small-sized grains as used in the present invention, even when variations in photographic characteristics with changes in silver potential are not produced, the "perfect cubes" are not necessarily formed.

SUMMARY OF THE INVENTION

An object of the present invention to provide a fine emulsion excellent in production stability and keeping quality.

Other objects and effects of the present invention will be apparent from the following description.

The present invention relates to a method for producing a silver halide emulsion containing silver halide grains having a mean grain size of 0.15 μm or less, wherein at least a part or the whole of a silver halide grain formation process is performed in the presence of an imidazole compound.

The method of the present invention includes the following preferred embodiments:

a method, wherein the imidazole compound is used in an amount of from $1\times10^{-5}$ to $1\times10^{-1}$ mol per mol of Ag;

a method, wherein at least one radical scavenger is added in the grain formation process;

a method, wherein the imidazole compound used in the grain formation process is represented by formula (I):

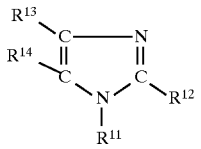

(I)

wherein $R^{11}$, $R^{12}$, $R^{13}$ and $R^{14}$, which may be the same or different, each represents a hydrogen atom, an unsubstituted or substituted alkyl, alkenyl, aryl group or aralkyl, in which a substituent group is at least one group selected from the group consisting of hydroxyl, cyano, alkoxyl, free or esterified carboxyl and sulfo groups;

a method, wherein the imidazole compound used in the grain formation process is represented by formula (II):

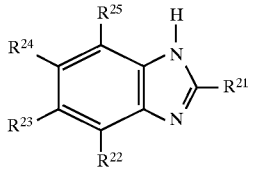

(II)

wherein $R^{21}$ represents a hydrogen atom, a halogen atom, an alkyl group, an alkenyl group, an aryl group or a heterocyclic residue; and $R^{22}$ to $R^{25}$, which may be the same or different, each represents a hydrogen atom, a halogen atom, a hydroxyl group, an amino group, a nitro group, a cyano group, a carboxyl group or a salt thereof, a sulfo group or a salt thereof, an alkyl group, an alkenyl group, an aryl group or an $R^{26}$—D— group, wherein $R^{26}$ represents an alkyl group or an aryl group, and —D— represents —$SO_2$—, —O—, —S—, —CO—, —COO—, —OCO—, —CONH—, —NHCO—, —$SO_2$NH— or —$NHSO_2$—;

a method, wherein the imidazole compound used in the grain formation process is represented by formula (III):

$$\text{—}(A)_X\text{—}(B)_Y\text{—} \quad \text{(III)}$$

wherein A represents a repeating unit derived from an ethylenic unsaturated monomer having at least one imidazole group; B represents a repeating unit derived from a monomer other than A; and X and Y represent the percentage by weight of the repeating units represented by A and B, respectively, and X is 0.1 to 100 and Y is 0 to 99.9;

a method, wherein the radical scavenger is represented by formula (A):

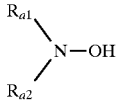

(A)

wherein $R_{a1}$ represents an alkyl group, an alkenyl group, an aryl group, a heterocyclic group, an acyl group, a sulfonyl group, a sulfinyl group, a carbamoyl group, a sulfamoyl group, an alkoxycarbamoyl group or an aryloxycarbonyl group; and $R_{a2}$ represents a hydrogen atom or the group represented by $R_{a1}$, with the proviso that when $R_{a1}$ is an alkyl group, an alkenyl group or an aryl group, $R_{a2}$ is a heterocyclic group, an acyl group, a sulfonyl group, a sulfinyl group, a carbamoyl group, a sulfamoyl group, an alkoxycarbonyl group or an aryloxycarbonyl group, and $R_{a1}$ and $R_{a2}$ may combine with each other to form a 5-, 6-, or 7-membered ring;

a method, wherein the radical scavenger is added in an amount of from $1\times10^{-5}$ to $1\times10^{-2}$ mol per mol of Ag; and a method, wherein the silver halide grains have a mean grain size of from 0.04 to 0.15 μm.

DETAILED DESCRIPTION OF THE INVENTION

The present invention is directed to a silver halide emulsion containing silver halide grains having a mean grain size of 0.15 μm or less.

The term "grain size" hereinafter used is defined as a simple mean value of diameters (di) of spheres identical to grains in volume, the diameters being determined by observation of the respective grains under an electron microscope.

The grain size in preferably 0.04 μm to 0.15 μm, because decreasing the grain size to less than 0.04 μm deteriorates stability.

A value obtained by dividing the standard deviation of di by the grain size is defined as the coefficient of variation of the grain size. It is preferred that the silver halide emulsion of the present invention has a coefficient of variation of 0.20 or less.

In the present invention, at least a part or the whole of the grain formation process is performed in the presence of an imidazole compound. In other words, the grain formation consuming 30% or more of silver nitrate (based on the total amount of silver nitrate consumed in the whole grain formation) is performed in the presence of the imidazole compound.

The imidazole compounds which can be used in the present invention is not limited and may be monomeric compounds or polymers, as long as they have an imidazole group. Compounds represented by formulae (I), (II), and (III) described below are preferably used, but the present invention is not limited thereto.

In the present invention, imidazole compounds represented by formula (I) can be used.

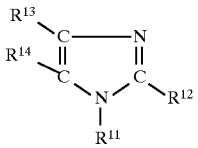

(I)

wherein $R^{11}$, $R^{12}$, $R^{13}$ and $R^{14}$, which may be the same or different, each represents a hydrogen atom, an unsubstituted or substituted alkyl, alkenyl, aryl or aralkyl group, in which a substituent group is at least one group selected from the group consisting of hydroxyl, cyano, alkoxyl, free or esterified carboxyl and sulfo groups.

Preferred examples of the alkyl groups include alkyl groups each having 1 to 8 carbon atoms, particularly 1 to 4 carbon atoms, such as methyl and ethyl.

Preferred examples of the alkenyl groups include alkenyl groups each having 2 to 8 carbon atoms, such as allyl, butenyl and hexenyl. Particularly preferred examples thereof include alkenyl groups each having 2 to 4 carbon atoms, such as vinyl and allyl.

Preferred examples of the aryl groups include aryl groups each having 6 to 12 carbon atoms, such as phenyl, biphenyl and naphthyl, and phenyl is particularly preferred.

Preferred examples of the aralkyl groups include aralkyl groups each having 1 to 2 carbon atoms in an aliphatic moiety and 6 to 12 carbon atoms in an aromatic moiety, such as benzyl and phenylethyl.

When the alkyl, alkenyl, aryl and aralkyl groups are substituted, a preferred example of the substituent group is at least one group selected from the group consisting of hydroxyl, cyano, alkoxyl, free or esterified carboxyl and sulfo groups.

Specific examples of the compounds represented by formula (I) are as follows:

| | |
|---|---|
| IM-1 | Imidazole |
| IM-2 | 1-Methylimidazole |
| IM-3 | 2-Methylimidazole |
| IM-4 | 1,2-Dimethylimidazole |
| IM-5 | 1-Allylimidazole |
| IM-6 | 1-Vinylimidazole |
| IM-7 | 1-Methoxymethylimidazole |
| IM-8 | 1-(2-Carboxyethyl)imidazole |
| IM-9 | 4-Methylimidazole |
| IM-10 | 2-Methyl-4-methylimidazole |

In the present invention, benzimidazole compounds represented by formula (II) can be used.

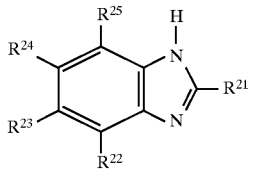

(II)

wherein $R^{21}$ represents a hydrogen atom, a halogen atom, an alkyl group, an alkenyl group, an aryl group or a heterocyclic residue; and $R^{22}$ to $R^{25}$, which may be the same or different, each represents a hydrogen atom, a halogen atom, a hydroxyl group, an amino group, a nitro group, a cyano group, a carboxyl group or a salt thereof, a sulfo group or a salt thereof, an alkyl group, an alkenyl group, an aryl group or an $R^{26}$—D— group, wherein $R^{26}$ represents an alkyl group or an aryl group, and —D— represents —$SO_2$—, —O—, —S—, -CO—, —COO—, —OCO—, —CONH—, —NHCO—, —$SO_2$NH— or —$NHSO_2$—.

In formula (II), $R^{21}$ represents a hydrogen atom, a halogen atom (such as Cl, Br or I), an alkyl group, an alkenyl group, an aryl group or a heterocyclic residue.

The alkyl groups include ones having substituent groups. The alkyl groups each has preferably 1 to 8 carbon atoms, and more preferably 1 to 4 carbon atoms. The substituent groups include hydroxyl groups, cyano groups, alkoxyl groups, unsubstituted, mono-substituted or di-substituted groups, morpholino groups, free or esterified carboxyl groups, free or esterified sulfo groups and aryl groups. Specific examples thereof include methyl, ethyl, propyl, hydroxymethyl, hydroxypropyl, diethylaminomethyl, morpholinomethyl, benzyl, phenethyl and carboxymethyl.

The alkenyl groups also include ones having substituent groups. The alkenyl groups each has preferably 3 to 8 carbon atoms, and more preferably 3 to 4 carbon atoms. The substituent groups include the same groups as described for the alkyl groups. Specific examples thereof include allyl, butenyl and octenyl.

The aryl groups also include ones having substituent groups. The aryl groups each has preferably 6 to 12 carbon atoms, and the substituent groups include those described for the alkyl groups above, and alkyl groups having 1 to 4 carbon atoms.

The heterocyclic residues are preferably 5- or 6-membered rings containing nitrogen or oxygen atoms as constituent members. Examples thereof include pyridyl, pyrimidyl and furyl, and 2-pyridyl is particularly preferred.

In formula (II), $R^{22}$ to $R^{25}$, which may be the same or different, each represents a hydrogen atom, a halogen atom (such as Cl, Br or I), a hydroxyl group, an amino group, a nitro group, a cyano group, a carboxyl group or a salt thereof (particularly, an alkali metal salt), a sulfo group or a salt thereof (particularly, an alkali metal salt), an alkyl group, an alkenyl group, an aryl group or an $R^{26}$—D— group (wherein $R^{26}$ represents an alkyl group or an aryl group, and —D— represents —$SO_2$—, —O—, —S—, —CO—, —COO—, —OCO—, —CONH—, —NHCO—, —$SO_2$NH— or —$NHSO_2$—).

Of the above, the alkyl, alkenyl and aryl groups are groups selected from the alkyl, alkenyl and aryl groups described for $R^{21}$ of formula (II).

The alkyl group indicated by $R^{26}$ in the $R^{26}$—D— group is preferably a lower alkyl group having 1 to 4 carbon atoms. The aryl group is preferably an aryl group having 6 to 12 carbon atoms, and phenyl is particularly preferred. Specific examples of the $R^{26}$—D— groups include methylsulfonyl, phenylsulfonyl, acetoxy, methoxycarbonyl, acetylamino, benzoleamino, carbamoyl, methylsulfonylamino and sulfamoyl.

Of the compounds represented by formula (II), a compound in which $R^{21}$ is a hydrogen atom or a lower alkyl group and $R^{22}$ to $R^{25}$ are hydrogen atoms is particularly preferred.

Specific examples of the compounds represented by formula (II) are shown below.

BI-1

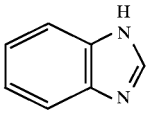

BI-2

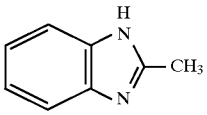

BI-3

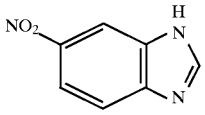

BI-4

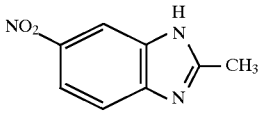

BI-5

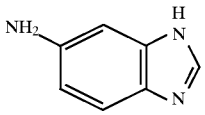

BI-6

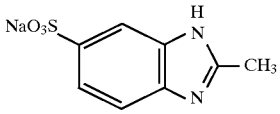

BI-7

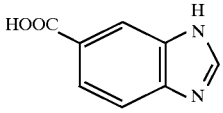

BI-8

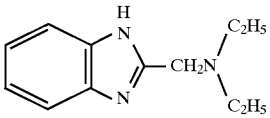

-continued

BI-9

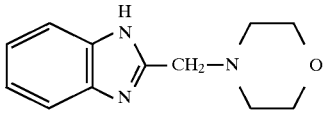

BI-10

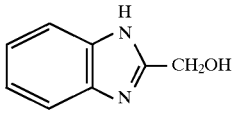

BI-11

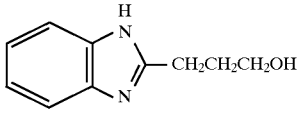

BI-12

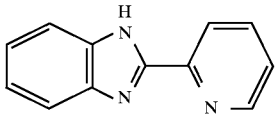

BI-13

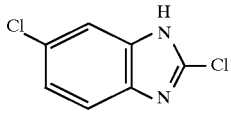

BI-14

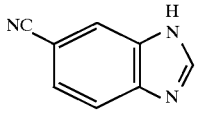

BI-15

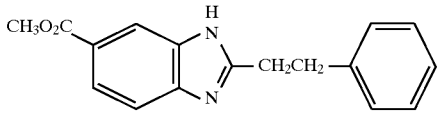

BI-16

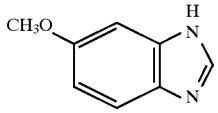

Further, imidazole group-containing synthetic polymers represented by formula (III) can also be used in the present invention.

$$\text{(A)}_X\text{(B)}_Y \qquad \text{(III)}$$

wherein A represents a repeating unit derived from an ethylenic unsaturated monomer having at least one imidazole group, B represents a repeating unit derived from a monomer other than A, X and Y each represents the percentage by weight of each component, and X is 0.1 to 100 and Y is 0 to 99.9.

Examples of the repeating units represented by A in formula (III), shown in the monomer form, include but are not limited to vinylimidazole, 2-methyl-1-vinylimidazole, N-acryloylimidazole, N-2-acryloyloxyethylimidazole and monomers having imidazole substituent groups such as N-vinylbenzyl-imidazole.

These monomers may be used alone in the polymers or copolymerized in combination.

The copolymerizable ethylenic unsaturated monomers represented by B are preferably monomers of which homopolymers are soluble in water, acidic aqueous solutions or alkaline aqueous solutions. Specific examples thereof include nonionic monomers such as acrylamide, methacrylamide, N-methylacryl-amide, N,N-dimethylacrylamide, N-acryloylmorpholine, N-ethylacrylamide, diacetoneacrylamide, N-vinylpyrrolidone and N-vinylacetamide, anionic group-containing monomers such as acrylic acid, methacrylic acid, itaconic acid, vinylbenzoic acid, styrenesulfonic acid, styrenesulfinic acid, phosphonoxy-ethyl acrylate, phosphonoxyethyl methacrylate, 2-acrylamido-2-methylpropanesulfonic acid, 3-acrylamidopropionic acid and 11-acrylamidoundecanoic acid, or salts thereof (for example, sodium, potassium or ammonium salts), and cationic group-containing monomers such as N,N,N-trimethyl-N-3-acrylamidopropylammonium chloride.

Further, such repeating units can contain copolymerizable components which become water-soluble by hydrolysis, etc. Such examples include repeating units of vinyl alcohol (obtained by hydrolysis of vinyl acetate units) and repeating units of maleic acid (obtained by ring opening of maleic anhydride).

Of the copolymerizable components described above, repeating units composed of the nonionic monomers or the anionic monomers are particularly preferred.

Such ethylenic unsaturated monomers may be used alone or copolymerized in combination as required.

Furthermore, other hydrophobic ethylenic unsaturated monomers can be introduced into the polymers of the present invention by copolymerization, as long as their water solubility is not impaired. Such monomers include, for example, ethylene, propylene, 1-butene, isobutene, styrene, α-methylstyrene, methyl vinyl ketone, monoethylenic unsaturated esters of fatty acids (such as vinyl acetate and allyl acetate), esters of ethylenic unsaturated monocarboxylic acids or dicarboxylic acids (such as methyl methacrylate, ethyl methacrylate, n-butyl methacrylate, n-hexyl methacrylate, 2-ethylhexyl methacrylate, cyclohexyl methacrylate, benzyl methacrylate, methyl acrylate, ethyl acrylate, n-butyl acrylate, 2-hydroxyethyl methacrylate, 2-methoxyethyl methacrylate, 2-methanesulfonamidoethyl methacrylate and monomethyl maleate), amides of ethylenic unsaturated monocarboxylic acids (such as t-butylacrylamide, t-octylacrylamide and 3-methoxypropylmethacrylamide), monoethylenic unsaturated compounds (such as acrylonitrile and methacrylonitrile) and dienes (such as butadiene and isoprene).

X and Y each represents the percentage by weight of each copolymerizable component and are variously variable depending on the structure of the monomer, the purpose for use, etc. X is 0.1 to 100, preferably 1 to 50 and more preferably 1 to 30; and Y is 0 to 99.9, preferably 50 to 99, and more preferably 70 to 90, where the total of X and Y is 100.

The polymers of the present invention can be produced by various polymerization methods such as solution polymerization, precipitation polymerization, suspension polymerization, bulk polymerization and emulsion polymerization. Methods for initiating polymerization include methods of using radical initiators, irradiation with light or radiations and thermal polymerization. These polymerization methods and methods for initiating polymerization are described, for example, in Tsuruta, *Kobunshi Gosei Hanno* (*Polymer Synthesis Reaction*), Revised Edition, Nikkan Kogyo Shinbunsha, 1971, and Ohtsu and Kinoshita, *Kobunshi Gosei no Jikkenho* (*Experiments of Polymer Synthesis*), pages 124 to 154, Kagaku Dohjin, 1972.

Of the above-mentioned polymerization methods, the solution polymerization using radical initiators is particularly preferred. Solvents used in the solution polymerization include water and organic solvents such as ethyl acetate, methanol, ethanol, 1-propanol, 2-propanol, acetone, dioxane, N,N-dimethylformamide, N,N-dimethylacetamide, toluene, n-hexane and acetonitrile. These organic solvents may be used alone, or as a combination of two or more of them, or as a mixed solvent with water. Of these, water or mixtures of water and water-miscible organic solvents are particularly preferred in the polymers used in the present invention.

The polymerization temperature is required to be established according to the molecular weight of the polymer to be produced, the kind of initiator, etc., and can be from 0° C. or less to 100° C. or more. Usually, polymerization is conducted at a temperature ranging from 30° C. to 100° C.

Preferred examples of the radical initiators used for polymerization include azo initiators such as 2,2'-azobisisobutyronitrile, 2,2'-azobis(2,4-dimethylvaleronitrile), 2,2'-azobis(2-amidinopropane) dihydrochloride and 4,4'-azobis(4-cyanopentanoic acid), and peroxide initiators such as benzoyl peroxide, t-butyl hydroperoxide and potassium persulfate (which may be used as a redox initiator in combination with sodium hydrogensulfite).

Although it is possible to adjust the amount of the initiator according to the polymerization properties of the monomer and the molecular weight required of the polymer, the amount thereof is preferably in the range of 0.01 to 10 mol % based on the monomer, and more preferably in the range of 0.01 to 2.0 mol %.

When the polymer used in the present invention is synthesized in the copolymer form, all of the monomers used may be first placed in a reaction vessel, followed by addition of the initiator to conduct polymerization. However, it is preferred to perform polymerization through the course of adding the monomers dropwise to a polymerization medium.

Two or more kinds of ethylenic unsaturated monomers may be all added dropwise as a mixture, or may be added dropwise separately. Further, when added dropwise, the ethylenic unsaturated monomers may be dissolved in an appropriate auxiliary solvent. The auxiliary solvents include water, organic solvents (for example, the solvents described above) and mixed solvents of water and the organic solvents.

Although the time required for dropping can be varied depending on the polymerization reactivity of the ethylenic unsaturated monomers, the polymerization temperature, etc., it is preferably 5 minutes to 8 hours, and more preferably 30 minutes to 4 hours. The dropping speed may be uniform during dropping or appropriately changed within the dropping time. When the ethylenic unsaturated monomers are added dropwise separately, the total dropping time and the dropping speed of each ethylenic unsaturated monomer can be freely varied as required. In particular, when the difference in polymerization reactivity between the ethylenic unsaturated monomers is large, it is preferred that the monomer higher in reactivity is added dropwise more slowly.

The polymerization initiator may be added to the polymerization solvent in advance or simultaneously with addition of the ethylenic unsaturated monomers. Further, a solution of the initiator in a solvent may be added dropwise separately from the ethylenic unsaturated monomers. Furthermore, two or more kinds of such methods of addition may be combined.

The polymer used in the present invention can be synthesized by the above-mentioned polymerization reaction using the imidazole group-containing ethylenic unsaturated monomer represented by A and the other ethylenic unsaturated monomer represented by B. However, it is also possible to synthesize the polymer by reacting an imidazole group-containing compound with a polymer having at least one functional group (for example, —OH, —COOH, —$NH_2$, —NHR, —RH or active halogen).

The imidazole group-containing compounds which can be effectively bound to such polymer chains include, for example, imidazole, 2-hydroxyethylimidazole, N-(3-aminopropyl)imidazole and 2-hydroxybenzimidazole.

The imidazole group-containing compounds and these polymers may be directly reacted with each other or bound to each other through diisocyanates, diols, dicarboxylic acids, diepoxides, etc.

Specific examples of the imidazole group-containing polymers represented by formula (III) in the present invention are shown below, but the present invention is not limited thereto. The numerals in parentheses indicate the percentages by weight of respective copolymer components.

P-1: Acrylamide/Sodium Acrylate/Vinylimidazole/Diacetoneacrylamide Copolymer (50/5/3/42)

P-2: Acrylamide/Sodium Acrylate/Vinylimidazole/Diacetoneacrylamide Copolymer (42/7/8/43)

P-3: Acrylamide/Sodium Acrylate/Vinylimidazole/Diacetoneacrylamide Copolymer (37/5/15/43)

P-4: Acrylamide/Acrylic Acid/Vinylimidazole Hydrochloride/Diacetoneacrylamide Copolymer (22/5/30/43)

P-5: Acrylamide/Sodium Acrylate/Vinylimidazole Copolymer (90/7/3)

P-6: Acrylamide/Sodium Acrylate/Vinylimidazole Copolymer (83/7/10)

P-7: Acrylamide/Vinylimidazole Copolymer (90/10)

P-8: Methacrylamide/Vinylimidazole Copolymer (90/10)

P-9: N,N-Dimethylacrylamide/Vinylimidazole Copolymer (92/8)

P-10: Acrylamide/Sodium Styrenesulfonate/Vinylimidazole Copolymer (80/10/10)

P-11: Methyl Methacrylate/Sodium 2-Acrylamido-2-methylpropanesulfonate/Vinylimidazole Copolymer (15/75/10)

P-12: Styrene/Acrylamide/Sodium 2-Acrylamido-2-methylpropanesulfonate/Vinylimidazole Copolymer (10/40/40/10)

P-13: Acrylamide/Sodium Methacrylate/2-Methyl-1-vinylimidazole/Diacetoneacrylamide Copolymer (45/5/10/40)

P-14: Acrylamide/2-Methyl-1-vinylimidazole Copolymer (85/15)

P-15: Acrylamide/Sodium Acrylate/Diacetoneacrylamide/2-Methyl-1-vinylimidazole Copolymer (38/22/30/10)

P-16: Acrylamide/1-Acryloyloxyethylimidazole Copolymer (80/20)

P-17: Acrylamide/N-Vinylpyrrolidone/1-Acryloyloxyethylimidazole Copolymer (85/5/10)

P-18: Acrylamide/Diacetoneacrylamide/N-Vinylbenzylimidazole Copolymer (50/40/10)

P-19: Sodium 2-Acrylamido-2-methylpropanesulfonate/3-Thiapentyl Acrylate/Vinylimidazole Copolymer (87/3/10)

P-20: Acrylamide/Vinylimidazole/N-Vinylbenzylpiperidine Copolymer (90/5/5)

P-21: Methyl Acrylate/Acrylamide/Sodium Acrylate/Vinylimidazole/1-Acryloyloxyethyltriazole Copolymer (15/57/15/10/3)

P-22: Acrylamide/Sodium Acrylate/Vinylimidazole/Dimethylaminomethylstyrene Copolymer (75/12/8/5)

Although the preferred range of the molecular weight or the degree of polymerization of the polymer used in the present invention varies according to the polymer structure, the molecular weight is preferably 5,000 to 1,000,000, and more preferably 10,000 to 500,000.

Among the imidazole compounds represented by formulae (I), (II), and (III), those represented by formula (II) are particularly preferred in the present invention.

The amount of the imidazole compound added is generally in the range of $1\times10^{-5}$ to $1\times10^{-1}$ mol/mol of Ag. In the case of the compound represented by formula (III), the amount added is indicated in terms of the molar amount of the repeating units represented by A in the formula.

The imidazole compound can be added by a method arbitrarily selected from, for example, the method of adding it as an aqueous solution, the method of adding as an acidic aqueous solution, the method of adding it as a solution in an organic solvent such as methanol, the method of directly adding it as a powder as it is, and the method of adding it in a molecular dispersion state together with gelatin.

The silver halide emulsion grains obtained in the present invention preferably have a silver chloride content of 3 mol % or less. If the silver chloride content is more than 3 mol %, the resulting emulsion tends to be unfavorably deteriorated in aging stability in the dissolved state.

Further, the silver halide emulsion grains obtained in the present invention preferably have a silver iodide content of 0.5 mol % or more. If the silver iodide content is less than 0.5 mol %, the resulting emulsion tends to be unfavorably deteriorated in aging stability in the dissolved state.

Furthermore, a silver iodide content is preferably less than 5 mol % since that of more than 5 mol % unfavorably results in low-contrast gradation.

The silver halide emulsion grains according to the present invention are preferably cubic.

In particular, it is preferred that the (100) plane ratio P (%) is as high as 85% or more. The (100) plane ratio P (%) is determined by the method described in *Journal of Image Science,* 29, 165 (1985), "Quantitative Determination of Crystal Habit of Silver Halide Grain Through Its Influence on Dye Adsorption".

The silver halide emulsions used in the present invention are usually obtained by adding silver ions and halogen ions while keeping the silver potential constant, using well-known controlled double jet methods. The silver potential is established near a value giving the minimum solubility of silver halides on the excess halogen side. The silver potential is preferably established between 10 mV and 80 mV.

Gelatin is placed in a reaction vessel, and the concentration thereof is 5 g/l to 100 g/l before initiation of grain formation. Gelatin can also be additionally added during grain formation or after termination of grain formation and before initiation of washing as required. In some cases, the fine silver halide emulsions as used in the present invention necessitate the amount of gelatin different from the amount of gelatin required from sedimentation properties in the salt removal stage and stability in the salt removal and after-ripening stages. In such cases, gelatin is additionally added as so desired.

The temperature of the reaction vessel can be arbitrarily selected within the range of 30° C. to 80° C., and can be changed in the course of grain formation if necessary.

The grain formation process may or may not be clearly separated into a nucleus forming part and a growing part in which nuclei are constant in number and grow. When both the parts are clearly separated, it is preferred that the rate of addition of silver and halogen to the growing portion is established to a value close to the critical growth rate.

Also in the salt removal step, the after-ripening step, and further the preparation step of each coating solution for each layer after grain formation, if the silver potential is not established between 10 mV to 80 mV, the silver halide grains are unfavorably coarsened by physical ripening.

It is preferred to use oxidizing agents to silver in the manufacturing stage of the emulsions of the present invention. It is particularly preferred to use the oxidizing agent if a silver halide solvent, such as ammonia, is used.

Oxidizing agents to silver mean compounds having the function of reacting with metallic silver to convert it to a silver ion. In particular, compounds are effective which convert extremely fine silver grains produced as a by-product in the course of formation of the silver halide grains and chemical sensitization to silver ions. The silver ions produced here may be form either silver salts slightly soluble in water such as silver halides, silver sulfide and silver selenide, or silver salts easily soluble in water such as silver nitrate. The oxidizing agents to silver may be inorganic compounds or organic compounds. Examples of the inorganic oxidizing agents include ozone; hydrogen peroxide and adducts thereof (for example, $NaBO_2.H_2O_2.3H_2O$, $2NaCO_3.3H_2O_2$, $Na_4P_2O_7.2H_2O_2$ and $2Na_2SO_4.H_2O_2.H_2O$); oxygen acid salts such as peroxy acid salts (for example, $K_2S_2O_8$, $K_2S_2O_6$ and $K_2P_2O_8$), peroxy complex compounds (for example, $K_2[Ti(O_2)C_2O_4].3H_2O$, $4K_2SO_4.Ti(O_2)OH.SO_4.2H_2O$ and $Na_3[VO(O_2)(C_2H_4)_2].6H_2O$), permanganates (for example, $KMnO_4$) and chromates (for example, $K_2Cr_2O_7$); halogen elements such as iodine and bromine; perhalogenates (for example, potassium periodate); salts of high valent metals (for example, potassium hexacyanoferrate (II)); and thiosulfonates.

Further, examples of the organic oxidizing agents include quinones such as p-quinone; organic peroxides such as peracetic acid and perbenzoic acid; and compounds releasing active halogen (for example, N-bromosuccinimide, chloramine T and chloramine B).

In the present invention, ozone, hydrogen peroxide and the adducts thereof, the halogen elements and the thiosulfonates are preferably used as inorganic oxidizing agents, and the quinones as organic oxidizing agents. It is preferred that the above-mentioned reduction sensitization is used in combination with the oxidizing agent to silver, which is selected for use from the method of subjecting to the reduction sensitization after use of the oxidizing agent, the method of using the oxidizing agent after the reduction sensitization and the method of using both concurrently. These methods can be selectively used either in the grain formation stage or in the chemical sensitization stage.

The silver halide emulsions prepared in the present invention may have distribution or structure in the grains thereof with respect to halogen composition. Typical examples thereof are core/shell type or double structure type grains in which the interiors thereof are different from the surface layers thereof in halogen composition as described in JP-B-43-13162, JP-A-61-143331, JP-A-60-222845 and JP-A-61-75337. The grains can also have triple structure or multiple structure more than triple as described in JP-A-60-222844, instead of simply double structure, and surfaces of these grains can be thinly coated with a silver halide different in composition.

In the case of silver iodobromide grains having such structure, the core portions may have a silver iodide content higher than the shell portions. Conversely, the shell portions may have a silver iodide content higher than the core portions.

For the grains having a sphere-corresponding diameter of 0.5 $\mu$m or less, dislocation lines can be observed under a transmission electron microscope. The silver halide grains according to the present invention may either have dislocation lines or contain no dislocation line at all. In the present invention, dislocation lines make it difficult to produce perfect cubes because of susceptibility to physical ripening. However, they may contain dislocation lines according to their purpose.

A dislocation line may be introduced linearly to a specified direction of crystal orientation of the grain or curvedly. Further, a dislocation line or dislocation lines may be introduced over the entire grain or into only a specified site of the grain, for example, a fringe portion of the grain.

When the dislocation lines are introduced into the specified fringe portion, it is possible to count the number of the dislocation lines per grain by observation under an electron microscope. In the case of the silver halide grains according to the present invention, the number of the dislocation lines observed is preferably 30 or less per grain, and more preferably 10 or less per grain.

In some cases, the methods of adding silver halide grains previously precipitated to a reaction vessel for preparation of emulsions (U.S. Pat. Nos. 4,334,012, 4,301,241 and 4,150,994) are preferred. These grains are used as seed crystals, and are also effectively provided as silver halides for growth. In the latter case, an emulsion having a small grain size is preferably added. A method for addition can be selected for use from addition of the total amount at once, addition of several divided portions and continuous addition. Further, in order to modify the surface, it is also effective to add grains of various silver halides in some cases.

Methods for converting most or just a part of the halogen composition of silver halide grains by the halogen conversion process are disclosed in U.S. Pat. Nos. 3,477,852 and 4,142,900, European Patents 273,429 and 273,430, and West German Patent Application (OLS) No. 3,819,241, and are effective grain forming methods. A solution of soluble halogen or silver halide grains can be added to convert to a more insoluble silver salt. These methods can be selected from conversion at once, several divided conversion and continuous conversion.

In addition to methods for allowing grains to grow by adding a soluble silver salt and a halogen salt at a constant concentration at a constant flow rate, methods for forming grains at varied concentrations or at varied flow rates as described in British Patent 1,469,480, U.S. Pat. Nos. 3,650,757 and 4,242,445 are preferred. The amount of the silver halide to be supplied can be varied as a linear function, a secondary function or a more complicated function of addition time by increasing the concentration or the flow rate. In some cases, it is also preferred that the amount of the silver halide is decreased if necessary. Furthermore, when a plurality of soluble silver salts or a plurality of soluble halogen salts different in solution composition are added, it is effective that they are added so that one is increased and the other is decreased.

A mixer used when solutions of a soluble halogen salt and a soluble silver salt are reacted with each other can be selected for use from ones described in U.S. Pat. Nos. 2,996,287, 3,342,605, 3,415,650 and 3,785,777, West German Patent Application (OLS) Nos. 2,556,885 and 2,555,364.

For the purpose of promoting ripening, silver halide solvents are useful. For example, the presence of an excess amount of halogen ions in a reaction vessel is known to promote ripening. Further, other ripening agents can also be used. The ripening agent can be added in the whole amount to a dispersion medium in a reaction vessel before addition of a silver salt(s) and a halide(s), or can also be introduced into the reaction vessel together with addition of the silver salt(s), the halide(s) and a deflocculant. As another modified embodiment, the ripening agent can also be independently introduced in the stage of addison of the halide(s) and the silver salt(s).

The silver halide solvents include ammonia, thiocyanates (for example, potassium rhodanide and ammonium rhodanide), organic thioether compounds (for example, compounds described in U.S. Pat. Nos. 3,574,628, 3,021,215, 3,057,724, 3,038,805, 4,276,374, 4,297,439, 3,704,130 and 4,782,013 and JP-A-57-104926), thione compounds (for example, 4-substituted thiourea described in JP-A-53-82408, JP-A-55-77737 and U.S. Pat. No. 4,221,863, and compounds described in JP-A-53-144319), mercapto compounds which can promote growth of silver halide grains (for example, compounds described in JP-A-57-202531), and amine compounds (for example, compounds described in JP-A-54-100717).

As protective colloids used in the preparation of the emulsions in the present invention, gelatin is advantageously used, but other hydrophilic colloids can also be used. Examples of the hydrophilic colloids which can be used include proteins such as gelatin derivatives, graft polymers of gelatin with other polymers, albumin and casein; cellulose derivatives such as hydroxyethyl cellulose, carboxymethyl cellulose and cellulose sulfates; saccharide derivatives such as sodium alginate and starch derivatives; and various synthetic hydrophilic polymers such as homopolymers and copolymers of polyvinyl alcohol, partially acetalized polyvinyl alcohol, poly-N-vinylpyrrolidone, polyacrylic acid, polymethacrylic acid, polyacrylamide, polyvinylimidazole, polyvinylpyrazole, etc.

As gelatin, acid-treated gelatin and enzyme-treated gelatin as described in *Bull. Soc. Sci. Photo. Japan,* 16, 30 (1966) may be used besides lime-treated gelatin. Hydrolyzed or enzymatically decomposed products of gelatin can also be used.

When the emulsions are prepared in the present invention, for example, in grain formation, in salt removal, in chemical sensitization or before coating, the presence of salts of metal ions are preferred according to the purpose. When the grains are doped with the metal salts, it is preferred that the metal salts are added in grain formation. When the metal salts are used for modification of surfaces of the grains or as chemical sensitizers, the metal salts are preferably added after grain formation and before termination of chemical sensitization. The method of doping the entire grain and the method of doping only a core portion, a shell portion, an epitaxial portion or a base portion of the grain can be selectively used. Examples of the metals which can be used include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. These metals can be added as long as they are in salt forms in which they can be dissolved in forming the grains, such as ammonium salts, acetates, nitrates, sulfates, phosphates, hydroxides, six-coordinate complexes and four-coordinate complexes. Examples of such salts include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$ and $K_4Ru(CN)_6$. A ligand of the coordination compound can be selected from halo, aquo, cyano, cyanate, thiocyanate, nitrosyl, thionitrosyl, oxo and carbonyl. These metal compounds may be used either alone or a combination of two or more of them.

In the present invention, it is particularly preferred to use iridium compounds. Suitable iridium compounds are water-soluble iridium salts and complex compounds. Particularly preferred examples of the iridium compounds include iridium trichloride, iridium tetrachloride and sodium, potassium or ammonium hexachloroiridate (III) or (V).

The amount of the iridium compound used is preferably $1\times10^{-10}$ mol to $1\times10^{-4}$ mol per mol of silver halide, and more preferably $1\times10^{-9}$ mol to $1\times10^{-6}$ mol per mol of silver halide.

The metal compound is preferably added as a solution thereof in an appropriate solvent such as methanol or acetone. In order to stabilize the solution, an aqueous solution of a hydrogen halide (for example, HCl or HBr) or an alkali halide (for example, KCl, NaCl, KBr or NaBr) can be added. An acid or an alkali may be further added if necessary. The metal compound can also be added to a reaction vessel before grain formation or in the course of grain formation. The metal compound may be previously added to an aqueous solution of a water-soluble silver salt (for example, $AgNO_3$) or an alkali halide (for example, NaCl, KBr or KI), followed by continuous addition thereof during formation of the silver halide grains. Further, a solution of the metal compound prepared independently of the solution of the water-soluble silver salt or the alkali halide may be continuously added at a suitable time during grain formation. Furthermore, it is also preferred to use various addition methods in combination.

The method of adding chalcogen compounds during preparation of emulsions as described in U.S. Pat. No. 3,772,031 is sometimes useful. Cyanates, thiocyanates, selenocyanates, carbonates, phosphates and acetates may be allowed to coexist, in addition to S, Se and Te.

The silver halide grains according to the present invention can be subjected to at least one of sulfur sensitization, selenium sensitization, gold sensitization, palladium sensitization, other noble metal sensitization and reduction sensitization at any manufacturing stages of the silver halide emulsions. It is preferred to combine two or more kinds of sensitizing methods. Various types of emulsions can be prepared depending on the stages at which the grains are subjected to chemical sensitization. There are three types, the type of embedding chemical sensitizing nuclei in the inside of the grains, the type of embedding the nuclei in shallow positions from surfaces of the grains and the type of preparing the nuclei on the surfaces of the grains. For the emulsions prepared in the present invention, the place at which the chemical sensitizing nucleus is located can be selected depending upon their purpose. However, it is generally preferred that at least one kind of chemical sensitizing nucleus is formed in the vicinity of the surface of the grain.

One chemical sensitization which can be preferably carried out in the present invention is chalcogen sensitization, noble metal sensitization or a combination thereof. It can be conducted using active gelatin as described in T. H. James, *The Theory of the Photographic Process,* 4th ed., pages 67 to 76, Macmillan (1977). Further, sulfur, selenium, tellurium, gold, platinum, palladium, iridium or a combination of these plural sensitizers can be used at a pAg of 5 to 10 at a pH of 5 to 8 at a temperature of 30° to 80° C. as described in *Research Disclosure,* Vol. 120, 12008 (April, 1974), ibid., Vol. 34, 13452 (June, 1975), U.S. Pat. Nos. 2,642,361, 3,297,446, 3,772,031, 3,857,711, 3,901,714, 4,266,018 and 3,904,415, and British Patent 1,315,755. In noble metal sensitization, salts of noble metals such as gold, platinum, palladium and iridium can be used, and particularly, gold sensitization, palladium sensitization and the combination of both are preferred among others. In the case of gold sensitization, known compounds such as chloroauric acid, potassium chloroaurate, potassium aurithiocyanate, gold sulfide and gold selenide can be used.

Palladium compounds mean divalent or tetravalent salts of palladium. Preferred palladium compounds are represented by $R_2PdX_6$ or $R_2PdX_4$, wherein R represents a hydrogen atom, an alkali metal atom or an ammonium group, and X represents a halogen atom such as chlorine, bromine or iodine.

Specifically, preferred examples thereof include $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$. It is preferred that the gold compounds and the palladium compounds are used in combination with thiocyanates or selenocyanates.

Hypo, thiourea compounds, rhodanine compounds and sulfur-containing compounds described in U.S. Pat. Nos. 3,857,711, 4,266,018 and 4,054,457 can be used as the sulfur sensitizers. Chemical sensitization can also be conducted in the presence of a so-called chemical sensitizing auxiliary. As the useful chemical sensitizing auxiliaries, compounds are used which are known to inhibit fogging and to enhance sensitivity in the course of chemical sensitization, such as azaindene, azapyridazine and azapyrimidine. Examples of the chemical sensitizing auxiliaries are described in U.S. Pat. Nos. 2,131,038, 3,411,914 and 3,554,757, JP-A-58-126526 and Duffin, *Photographic Emulsion Chemistry.* pages 138 to 143.

In the emulsions prepared in the present invention, gold sensitization is preferably used in combination. The amount of the gold sensitizer is preferably $1\times10^{-4}$ to $1\times10^{-7}$ mol/mol of silver halide, and more preferably $1\times10^{-5}$ to $1\times10^{-7}$ mol/mol. The amount of the palladium compound is preferably $1\times10^{-3}$ to $5\times10^{-7}$ mol/mol of silver halide, and the amount of the thiocyanate compound or the selenocyanate compound is preferably $5\times10^{-2}$ to $1\times10^{-6}$ mol/mol of silver halide.

The amount of the sulfur sensitizer used in the silver halide grains is preferably $1\times10^{-4}$ to $1\times10^{-7}$ mol/mol of silver halide, and more preferably $1\times10^{-5}$ to $5\times10^{-7}$ mol/mol.

As a preferred sensitizing method to the emulsions of the present invention, there is selenium sensitization. In selenium sensitization, known unstable selenium compounds are used. Specifically, selenium compounds such as colloidal metallic selenium, selenourea compounds (for example, N,N-dimethylselenourea and N,N-diethylselenourea), selenoketones and selenoamides can be used. In some cases, selenium sensitization is preferably used in combination with sulfur sensitization, noble metal sensitization or both.

It is preferred for exhibiting the effect of the invention to spectrally sensitizing the photographic emulsions with methine dyes and so on. Examples of the dyes used include cyanine dyes, merocyanine dyes, complex cyanine dyes, complex merocyanine dyes, holopolar cyanine dyes, hemicyanine dyes, styryl dyes and hemioxonol dyes. Of these, cyanine dyes, merocyanine dyes and complex merocyanine dyes are particularly useful. Any nuclei usually used in cyanine dyes as basic heterocyclic nuclei may be applied to these dyes. That is, the nuclei which can be applied include pyrroline, oxazoline, thiazoline, pyrrole, oxazole, thiazole, selenazole, imidazole, tetrazole and pyridine nuclei; nuclei formed by fusing alicyclic hydrocarbon rings together with these nuclei; and nuclei formed by fusing aromatic hydrocarbon rings together with these nuclei, that is, indolenine, benzindolenine, indole, benzoxazole, naphthoxazole, benzothiazole, naphthothiazole, benzoselenazole, benzimidazole and quinoline nuclei. These nuclei may be substituted on carbon atoms.

5-Membered and 6-membered heterocyclic nuclei such as pyrazolin-5-one, thiohydantoin, 2-thioxazolidin-2,4-dione, thiazolidin-2,4-dione, rhodanine and thiobarbituric acid can be applied to the merocyanine dyes or the complex merocyanine dyes as nuclei having the ketomethylene structure.

These sensitizing agents may be used alone or in combination. The combinations of the sensitizing agents are frequently used, particularly for supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,614,609, 3,837,862 and 4,026,707, British Patents 1,344,281 and 1,507,803, JP-B-43-4936, JP-B-53-12375, JP-A-52-110618 and JP-A-52-109925.

The emulsions may contain dyes themselves having no spectral sensitizing action or substances which do not substantially absorb visible light and show supersensitization, as well as the sensitizing dyes.

The sensitizing dyes may be added to the emulsions at any stage of emulsion preparation which has hitherto been known to be useful. Most usually, the sensitizing dyes are added after completion of chemical sensitization and before coating. However, the sensitizing dyes and chemical sensitizers can be concurrently added to conduct spectral sensitization and chemical sensitization at the same time, as described in U.S. Pat. Nos. 3,628,969 and 4,225,66. Further, the sensitizing dyes can be added prior to chemical sensitization, as described in JP-A-58-113928, and they can also be added before completion of precipitation formation of the silver halide grains to initiate spectral sensitization. It is also possible to add the above-mentioned compounds in parts as taught in U.S. Pat. Nos. 4,225,666, namely to add parts of the compounds prior to chemical sensitization and the remainders thereof after chemical sensitization. Including the method disclosed in U.S. Pat. No. 4,183,756, the sensitizing dyes may be added at any time.

The sensitizing dyes can be added in an amount of $4\times10^{-6}$ to $8\times10^{-3}$ mol per mol of silver halide. When the size of the silver halide grains ranges from 0.2 to 1.2 $\mu$m, the sensitizing dyes are effectively added in an amount of $5\times10^{-5}$ to $2\times10^{-3}$ mol per mol of silver halide.

It is preferred that the silver halide emulsions according to the present invention are subjected to reduction sensitization during grain formation, after grain formation and before chemical sensitization or during chemical sensitization, or after chemical sensitization.

For reduction sensitization, any method can be selected from the method of adding reduction sensitizers to the silver halide emulsions, the method of growing or ripening in an atmosphere of a low pAg of 1 to 7 which is called silver ripening, and the method of growing or ripening in an atmosphere of a high pH of 8 to 11 which is called high pH ripening. Further, two or more methods can be used in combination.

The methods of adding the reduction sensitizers are preferred in that the level of reduction sensitization can be delicately controlled.

Examples of the known reduction sensitizers include stannous salts, ascorbic acid and derivatives thereof, amines and polyamines, hydrazine derivatives, formamidinesulfinic acid, silane compounds and borane compounds. In reduction sensitization used in the present invention, these known reduction sensitizers can be selected for use, and two or more kinds of compounds can also be used in combination. Preferred compounds as the reduction sensitizers include stannous chloride, thiourea dioxide, dimethylamine borane, ascorbic acid and derivatives thereof. It is appropriate that the reduction sensitizers are added in an amount of $10^{-7}$ to $10^{-3}$ mol per mol of silver halide, although the amount added is required to be selected because of its dependency on the manufacturing conditions of the emulsions.

The reduction sensitizers are dissolved in solvents such as alcohols, glycols, ketones, esters and amides, and added during grain growth. Although they may be previously added to a reaction vessel, it is preferred to add them at an appropriate time of grain growth. Further, the reduction sensitizers may be previously added to aqueous solutions of water-soluble silver salts or water-soluble alkali halides, and using these aqueous solutions, the silver halide grains may be precipitated. Furthermore, it is also preferred that solutions of the reduction sensitizers may be added in parts at several times with grain growth, or may be continuously added for a long period of time.

The photographic emulsions prepared in the present invention may contain various compounds to prevent fogging during manufacturing stages, storage or photographic processing of the photographic materials or to stabilize photographic properties thereof. Namely, many compounds known as antifoggants or stabilizers can be added. Examples of such compounds include thiazoles such as benzothiazolium salts, nitroimidazoles, nitrobenzimidazoles, chlorobenzimidazoles, bromobenzimidazoles, mercaptothiazoles, mercaptobenzo-thiazoles, mercaptobenzimidazoles, mercaptothiadiazoles, aminotriazoles, benzotriazoles, nitrobenzotriazoles, mercaptotetrazoles (particularly, 1-phenyl-5-mercapto-tetrazole), mercaptopyrimidines, mercaptotriazines, thioketo compounds such as oxazolinethione, and azaindenes such as triazaindenes, tetraazaindenes (particularly, 4-hydroxy-substituted (1,3,3a,7)-tetraazaindenes) and pentaazaindenes. For example, the compounds described in U.S. Pat. Nos. 3,954,474 and 3,982,947 and JP-B-52-28660 can be used. One of the preferred compounds is the compound described in JP-A-63-212932. The antifoggants and the stabilizers can be added at various times, for example, before grain formation, during grain formation, after grain formation, in a washing stage, in dispersing after washing, before chemical sensitization, during chemical sensitization, after chemical sensitization and before coating, depending on their purpose. In addition to allowing the photographic materials to exhibit original antifogging effect and stabilizing effect by addition of them during preparation of the emulsions, they can be used for the multiple purposes of controlling the crystal habit of the grains, decreasing the grain size, reducing the solubility of the grains, controlling chemical sensitization and controlling the arrangement of dyes.

The radical scavenger used in the present invention means a compound which substantially extinguishes galvinoxyl (decreases an absorbance at 430 nm) when a 0.05 mmol/dm$^3$ solution of galvinoxyl in ethanol is mixed with a 2.5 mmol/dm$^3$ solution of a test compound in ethanol at 25° C. by the stopped flow method and changes with time in absorbance at 430 nm are measured. If the compound to be tested is not dissolved to the above-mentioned concentration, the measurement may be made at a reduced concentration.

The extinction rate constant of galvinoxyl determined by the above-mentioned method is preferably 0.01 mmol$^{-1}$s$^{-1}$dm$^3$ or more, and more preferably 0.1 mmol$^{-1}$s$^{-1}$dm$^3$ or more.

The method for determining the radical scavenging rate by use of galvinoxyl is described in *Microchemical Journal,* 31, 18–21 (1985), and the stopped flow method is described, for example, in *Bunkoh Kenkyu,* 19 (6), 321 (1970).

In the present invention, it is more preferred to use compounds represented by formula (A) as the radical scavengers. The compounds represented by formula (A) are hereinafter described in detail.

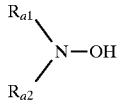

(A)

wherein $R_{a1}$ represents an alkyl group (having preferably 1 to 36 carbon atoms and more preferably 1 to 26 carbon atoms, for example, methyl, ethyl, i-propyl, cyclopropyl, butyl, i-butyl, cyclohexyl, t-octyl, decyl, dodecyl, hexadecyl or benzyl), an alkenyl group (having preferably 2 to 36 carbon atoms and more preferably 2 to 26 carbon atoms, for example, allyl, 2-butenyl, i-propenyl, oleyl or vinyl), an aryl group (having preferably 6 to 40 carbon atoms and more preferably 6 to 30 carbon atoms, for example, phenyl or naphthyl), a heterocyclic group (a group forming a 5-, 6-, or 7-membered heterocycle having at least one of a nitrogen atom, a sulfur atom, an oxygen atom and a phosphorus atom as a ring constituent group, preferably a nitrogen-containing heterocycle, more preferably having 1 to 4 nitrogen atoms, and most preferably a 5- or 6-membered heterocycle having 1 to 3 nitrogen atoms, for example, 1,3,5-triazine-2-yl, 1,2,4-triazine-3-yl, pyridine-2-yl, pyrazinyl, pyrimidinyl, purinyl, quinolyl, imidazolyl, 1,2,4-triazole-3-yl, benzimidazole-2-yl, thienyl, furyl, imidazolidinyl, pyrrolinyl, tetrahydrofuranyl or morpholinyl), an acyl group (for example, acetyl, benzoyl, pivaloyl, a-(2,4-di-tert-amylphenoxy)butyryl, myristoyl, stearoyl, naphthoyl, m-pentadecylbenzoyl or isonicotinoyl), a sulfonyl group (preferably, sulfonyl of alkane or aryl, for example, methane-sulfonyl, octanesulfonyl, benzenesulfonyl or toluenesulfonyl), a sulfinyl group (preferably, sulfinyl of alkane or aryl, for example, methanesulfinyl or benzenesulfinyl), a carbamoyl group (for example, N-ethylcarbamoyl, N-phenylcarbamoyl, N,N-dimethylcarbamoyl or N-butyl-N-phenylcarbamoyl), a sulfamoyl group (for example, N-methylsulfamoyl, N,N-diethylsulfamoyl, N-phenylsulfamoyl, N-cyclohexyl-N-phenylsulfamoyl or N-ethyl-N-dodecylsulfamoyl), an alkoxycarbamoyl group (for example, methoxycarbonyl, cyclohexyloxycarbonyl, benzyloxycarbonyl, isoamyloxycarbonyl or hexadecyloxycarbonyl), or an aryloxycarbonyl group (for example, phenoxycarbonyl or naphthoxycarbonyl); and $R_{a2}$ represents a hydrogen atom or the group represented by $R_{a1}$. $R_{a1}$ and $R_{a2}$ may combine with each other to form a 5-, 6-, or 7-membered ring (for example, a succinimide ring, a phthalimide ring, a triazole ring, an urazole ring, a hydantoin ring or a 2-oxo-4-oxazolidinone ring).

The groups represented by $R_{a1}$ and $R_{a2}$ in formula (A) may be further substituted by substituent groups. Examples of such substituent groups include alkyl, alkenyl, aryl, heterocyclic, hydroxyl, alkoxyl, aryloxy, alkylthio, arylthio, amino, acylamino, sulfonamido, alkylamino, arylamino, carbamoyl, sulfamoyl, sulfo, carboxyl, halogen, cyano, nitro, sulfonyl, acyl, alkoxycarbonyl, aryloxycarbonyl, acyloxy and hydroxyamino groups.

Of the compounds represented by formula (A), a compound in which $R_{a1}$ is a heterocyclic group is preferred. A compound in which $R_{a1}$ is a heteroaromatic ring group (also including a heterocyclic group capable of forming a heteroaromatic ring formally, of equilibrium geometries, hereinafter the same) is more preferred.

A compound represented by formula (A-I) is more preferred:

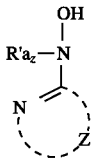

(A-I)

wherein $R'_{a2}$ represents a hydrogen atom, an alkyl group, an alkenyl group or an aryl group; and Z represents a heteroaromatic ring group.

Of the compounds represented by formula (A-I), a compound in which $R'_{a2}$ is a hydrogen atom or an alkyl group is preferred. Z is preferably a group comprising a carbon atom(s) or a nitrogen atom(s) as a ring constituent atom(s), and more preferably a nonmetallic atomic group having 1 to 4 nitrogen atoms and necessary for forming a 5-, 6- or 7-membered heterocycle.

A compound represented by formula (A-II) is the most preferred.

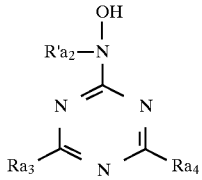

(A-II)

wherein $R'_{a2}$ represents the same group as $R'_{a2}$ given for formula (A-I); and $R_{a3}$ and $R_{a4}$, which may be the same or different, each represents a hydrogen atom or a substituent group.

Of the compounds represented by formula (A-II), a compound in which $R_{a3}$ and $R_{a4}$ are hydroxyamino, hydroxyl, amino, alkylamino, arylamino, alkoxyl, aryloxy, alkylthio, arylthio, alkyl or aryl groups is particularly preferred.

Specific examples of the compounds represented by formula (A) are shown below, but the present invention is not limited thereby.

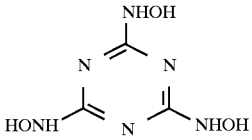

A-1

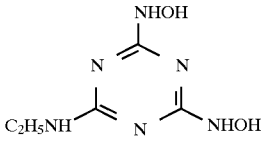

A-2

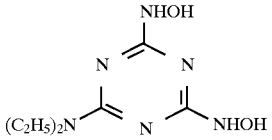

A-3

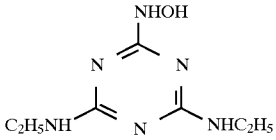

A-4

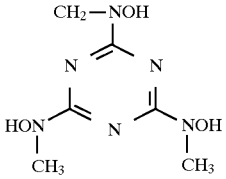

A-5

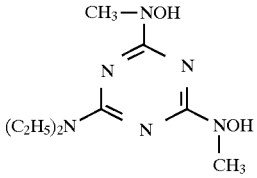

A-6

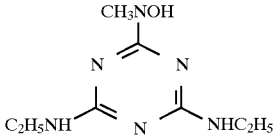

A-7

-continued
A-8
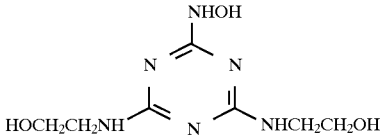
A-9
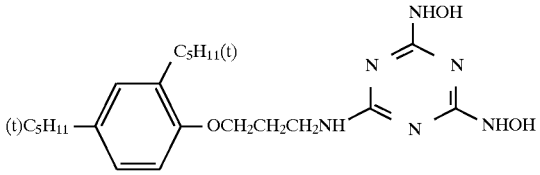
A-10
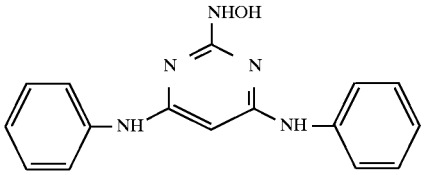
A-11
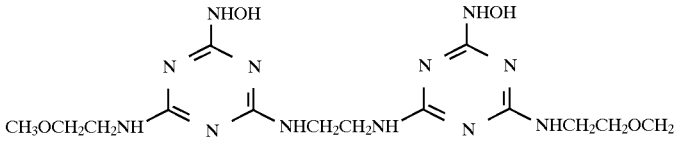
A-12
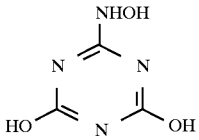
A-13
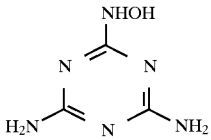
A-14
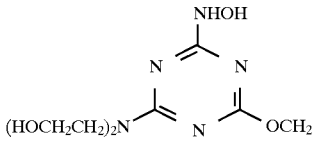
A-15
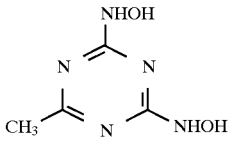
A-16
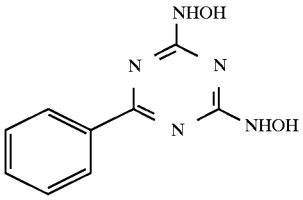
A-17
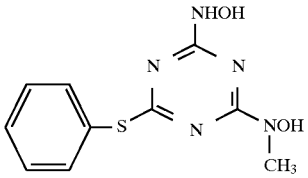

-continued
A-18
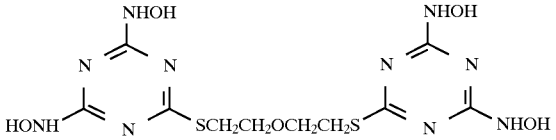
A-19
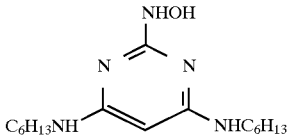
A-20
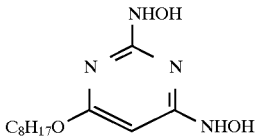
A-21
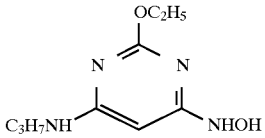
A-22
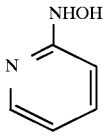
A-23
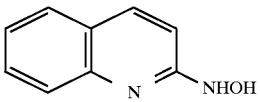
A-24
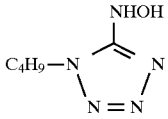
A-25
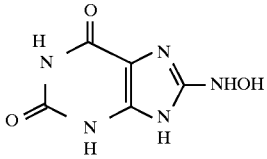
A-26
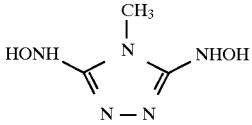
A-27
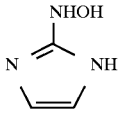
A-28
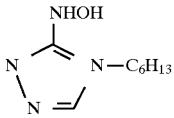
A-29
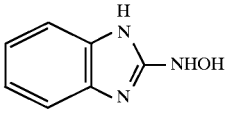

-continued
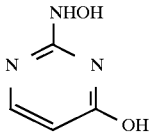
A-30
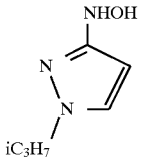
A-31
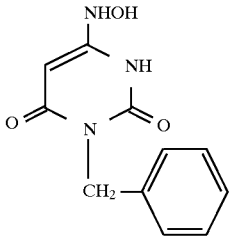
A-32
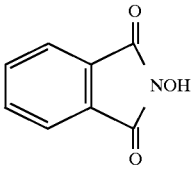
A-33
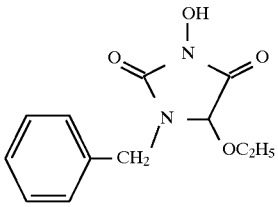
A-34
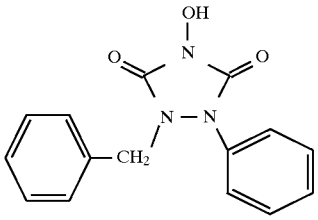
A-35
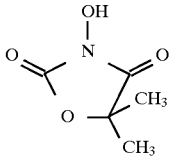
A-36
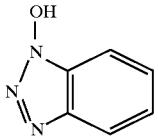
A-37
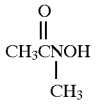
A-38

-continued

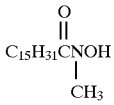

A-39

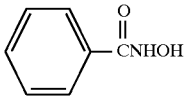

A-40

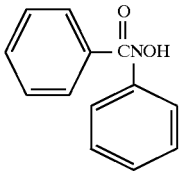

A-41

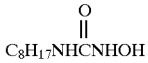

A-42

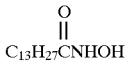

A-43

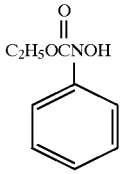

A-44

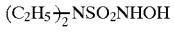

A-45

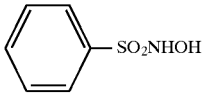

A-46

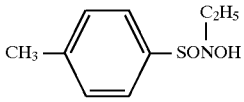

A-47

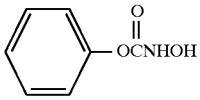

A-48

These compounds used in the present invention can be easily synthesized by the methods described in *J. Org. Chem.,* 27, 4054 (1962), *J. Amer. Chem. Soc.,* 73, 2981 (1951), JP-B-49-10692, etc., or by methods based thereon.

For some radical scavengers, the extinction rate constant of galvinoxyl is shown in Table 1.

TABLE 1

| Compound | Extinction Rate Constant ($mmol^{-1}s^{-1}dm^3$) |
|---|---|
| A-3 | 0.8 |
| A-4 | 0.3 |
| A-9 | 0.9 |

In the present invention, the radical scavengers may be added as solutions thereof in water or water-soluble liquids such as methanol and ethanol, or as emulsions or dispersions thereof. If the solubility of the radical scavengers in water is increased at a higher or lower pH, the radical scavengers may be dissolved at a higher or lower pH, and the resulting solutions may be added.

In the present invention, two or more kinds of radical scavengers may be used in combination.

The radical scavengers can be added at any time from during grain formation to before termination of chemical sensitization. However, they are added preferably just before termination of reduction sensitization, and more preferably just before termination of chemical sensitization. The pH at which the radical scavengers are added is preferably 7 or less, and more preferably 6 or less.

In the present invention, the term "before initiation of chemical sensitization" means before addition of a chalcogen sensitizer or a gold sensitizer, and the term "termination of chemical sensitization" means the time at which the temperature is lowered after chemical sensitization.

The amount of the radical scavenger added is $1\times10^{-5}$ to $1\times10^{-2}$ mol per mol of Ag, and more preferably $1\times10^{-4}$ to $5\times10^{-3}$ mol per mol of Ag.

In a multilayer silver halide photographic material, a plurality of silver halide emulsions are usually used. When some of these emulsions are the emulsions of the present invention, the amounts of the radical scavengers added to the emulsions of the present invention are substantially decreased because of diffusion of the radical scavengers in the photographic material. The radical scavengers can be further added in coating.

The above-mentioned various additives are used in the photographic materials in respect to this technique, various additives other than these can be used according to their purpose.

These additives are described in *Research Disclosure,* Item 17643 (December, 1978), ibid., Item 18716 (November, 1979) and ibid., Item 308119 (December, 1989) in greater detail, and corresponding portions thereof are summarized in the following table.

| Type of Additives | RD 17643 | RD 18716 | RD 307105 |
|---|---|---|---|
| 1. Chemical Sensitizers | p. 23 | p. 648, right column | p. 996 |
| 2. Sensitivity Increasing Agents | | p. 648, right column | |
| 3. Spectral Sensitizers, Supersensitizers | pp. 23–24 | p. 648, right column to p. 649, right column | p. 996, right to p. 998, right |
| 4. Brightening Agents | p. 24 | | p. 998, right |
| 5. Antifoggants, Stabilizers | pp. 24–25 | p. 649, right column | p. 998, right to p. 1000, right |
| 6. Light Absorbers, Filter dyes, UV Absorbers | pp. 25–26 | p.649, right column to p. 650, left column | p. 1003, left to p. 1003, right |
| 7. Stain Inhibitors | p. 25, right column | p. 650, left to right columns | p. 1002, right |
| 8. Dye Image Stabilizers | p. 25 | | p. 1002, right |
| 9. Hardeners | p. 26 | p. 651, left column | p. 1004, right to p. 1005, left |
| 10. Binders | p. 26 | p. 651, left column | p. 1003, right to p. 1004, right |
| 11. Plasticizers, Lubricants | p. 27 | p. 650, right column | p. 1006, left to right |
| 12. Coating Aids, Surfactants | pp. 26–27 | p. 650 right column | p. 1005, left to p. 1006, left |
| 13. Antistatic Agents | p. 27 | p. 650 right column | p. 1006, right to p. 1007, left |
| 14. Matte Finishing Agents | | | p. 1008, left to p. 1009, left |

The photographic material according to the present invention only requires that a support is provided with at least one layer of silver halide emulsion layers such as blue-sensitive, green-sensitive and red-sensitive layers. There is no particular limitation on the number and the order of arrangement of the silver halide emulsion layers and light-insensitive layers. A typical example thereof has at least one light-sensitive layer on a support, the light-sensitive layer comprising a plurality of silver halide emulsion layers which are substantially identical in spectral sensitivity and different in sensitivity. The light-sensitive layer is a unit light-sensitive layer having spectral sensitivity to any one of blue, green and red lights. In general, in the unit light-sensitive layer of the multilayer silver halide color photographic material, the red-sensitive layer, the green-sensitive layer and the blue-sensitive layer are arranged from the support side in this order. However, the above-mentioned order of arrangement may be reversed, or such an arrangement that a layer having a different spectral sensitivity is sandwiched between layers having the same spectral sensitivity may also be adopted, depending on its purpose.

A light-insensitive layer such as an intermediate layer, etc. may be provided between the above-mentioned silver halide light-sensitive layers, or in the uppermost layer or the lowermost layer.

The intermediate layers may contain couplers or DIR compounds described in JP-A-61-43748, JP-A-59-113438, JP-A-59-113440, JP-A-61-20037 and JP-A-61-20038, and may contain color stain preventing agents, as usually employed.

As the plural silver halide emulsion layers constituting each unit light-sensitive layer, a two-layer structure of a high-sensitivity emulsion layer and a low-sensitivity emulsion layer can be preferably used as described in West German Patent 1,121,470 and British Patent 923,045. It is usually preferred that the emulsion layers are arranged so as to decrease in sensitivity toward a support in turn. The light-insensitive layer may also be provided between the respective silver halide emulsion layers. Further, low-sensitivity emulsion layers may be arranged apart from a support and high-sensitivity layers near to the support, as described in JP-A-57-112751, JP-A-62-200350, JP-A-62-206541 and JP-A-62-206543.

Examples thereof include an arrangement in the order of low-sensitivity blue-sensitive layer (hereinafter referred to as BL)/high-sensitivity blue-sensitive layer (hereinafter referred to as BH)/high-sensitivity green-sensitive layer (hereinafter referred to as GH)/low-sensitivity green-sensitive layer (hereinafter referred to as GL)/high-sensitivity red-sensitive layer (hereinafter referred to as RH)/low-sensitivity red-sensitive layer (hereinafter referred to as RL) from the side farthest from a support; an arrangement in the order of BH/BL/GL/GH/RH/RL; and an arrangement in the order of BH/BL/GH/GL/RL/RH.

As described in JP-B-55-34932, layers can also be arranged in the order of blue-sensitive layer/GH/RH/GL/RL from the side farthest from a support. Further, layers can also be arranged in the order of blue-sensitive layer/GL/RL/GH/RH from the side farthest from a support, as described in JP-A-56-25738 and JP-A-62-63936.

Furthermore, three layers different in sensitivity may be arranged so that the upper layer is a silver halide emulsion layer having the highest sensitivity, the middle layer is a silver halide emulsion layer having a sensitivity lower than that of the upper layer, the lower layer is a silver halide emulsion layer having a sensitivity further lower than that of the middle layer, and the sensitivity of the three layers is successively decreased toward a support, as described in JP-B-49-15495. Even when such three layers different in sensitivity are arranged, they may be arranged in the order of middle-sensitivity emulsion layer/high-sensitivity emulsion layer/low-sensitivity emulsion layer from the side remote from the support in the same layer having the same spectral sensitivity, as described in JP-A-59-202464.

In addition, they may be arranged in the order of high-sensitivity emulsion layer/low-sensitivity emulsion layer/middle-sensitivity emulsion layer, or low-sensitivity emulsion layer/middle-sensitivity emulsion layer/high-sensitivity emulsion layer.

In the case of four layers or more, the arrangement may also be changed as described above.

As described above, various layer structures and arrangements can be selected depending on the purpose of each photographic material.

In the photographic materials according to the present invention, it is preferred that light-insensitive fine silver halide grains are contained. The light-insensitive fine silver halide grains means fine silver halide grains that are not exposed upon imagewise exposure for obtaining color images and are substantially not developed on the developing process for the color images. The light-insensitive fine silver halide grains are preferably not coupled with couplers.

The light-insensitive fine silver halide grains has a silver bromide content of from 0 to 100 mol % and may contain silver chloride and/or silver iodide if necessary. It is preferred that the light-insensitive fine silver halide grains contain from 0.5 to 10 mol % of silver iodide.

The light-insensitive fine silver halide grains preferably has an average diameter (average value of diameters of projected areas corresponding to circle) of from 0.01 to 0.5 μm, and more preferably from 0.02 to 0.2 μm.

The light-insensitive fine silver halide grains can be prepared in the similar manner as those for general light-sensitive silver halide grains. The surface of the light-insensitive fine silver halide grains is not necessary to be optically sensitized, and spectral sensitization is not necessary. Before adding the light-insensitive fine silver halide grains to a coating solution, it is preferred that a known stabilizer (such as triazole compounds, azaindene compounds, benzothiazorium compounds, mercapto compouns and zinc compounds) is added thereto. It is preferred that colloidal silver is added to the layer containing the light-insensitive fine silver halide grains.

It is preferred that the photographic materials according to the present invention contain compounds described in JP-A-1-106052 which release fogging agents, development accelerators, silver halide solvents or precursors thereof, regardless of the amount of developed silver produced by development processing.

The photographic materials preferably contain dyes dispersed by methods described in PCT International Publication No. WO88/04794 and JP-W-1-502912 (the term "JP-W" as used herein means an unexamined published international patent application) or dyes described in EP-A-317308, U.S. Pat. No. 4,420,555 and JP-A-1-259358.

Various color couplers can be used in the photographic materials according to the present invention. Examples thereof are described in the patents cited in *Research Disclosure,* No. 17643, VII-C to G and ibid. No. 307105, VII-C to G described above.

Preferred examples of yellow couplers are described in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649 and EP-A-249473.

As magenta couplers, 5-pyrazolone compounds and pyrazoloazole compounds are preferably used. Particularly preferred examples thereof are described in U.S. Pat. Nos. 4,310,619 and 4,351,897, European Patent 73,636, U.S. Pat. Nos. 3,061,432 and 3,725,067, *Research Disclosure,* No. 24220 (June, 1984), JP-A-60-33552, *Research Disclosure,* No. 24230 (June, 1984), JP-A-60-43659, JP-A-61-72238, JP-A-60-35730, JP-A-55-118034, JP-A-60-185951, U.S. Pat. Nos. 4,500,630, 4,540,654 and 4,556,630 and PCT International Publication No. WO88/04795.

Cyan couplers include phenol couplers and naphthol couplers. Preferred examples thereof are described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, EP-A-121365 and EP-A-249453, U.S. Pat. Nos. 3,446,622, 4,333,999, 4,775,616, 4,451,559, 4,427,767, 4,690,889, 4,254,212 and 4,296,199 and JP-A-61-42658.

Typical examples of dye-forming polymer couplers are described in U.S. Pat. Nos. 3,451,820, 4,080,211, 4,367,282, 4,409,320 and 4,576,910, British Patent 2,102,137 and EP-A-341188.

Preferred examples of couplers whose forming dyes have appropriate diffusibility include those described in U.S. Pat. No. 4,366,237, British Patent 2,125,570, European Patent 96,570 and West German Patent Application (OLS) No. 3,234,533.

Preferred colored couplers for correcting unnecessary absorption of forming dyes are described in *Research Disclosure,* No. 17643, Item VII-G, ibid. 307105, Item VII-G, U.S. Pat. No. 4,163,670, JP-B-57-39413, U.S. Pat. Nos. 4,004,929 and 4,138,258 and British Patent 1,146,368. It is also preferred to use couplers for correcting unnecessary absorption of forming dyes with fluorescent dyes released on coupling, and to use couplers having dye precursor groups as eliminable groups which can react with developing agents to form dyes. The former couplers are described in U.S. Pat. No. 4,774,181 and the latter couplers are described in U.S. Pat. No. 4,777,120.

Couplers which release photographically useful residues on coupling can also be preferably used in the present invention. Preferred DIR couplers which release development restrainers are described in the patents cited in *Research Disclosure,* No. 17643, Item VII-F and ibid., No. 307105, Item VII-F described above, JP-A-57-151944, JP-A-57-154234, JP-A-60-184248, JP-A-63-37346, JP-A-63-37350 and U.S. Pat. Nos. 4,248,962 and 4,782,012.

Preferred couplers which imagewise release nucleating agents or development accelerators on development are described in British Patents 2,097,140 and 2,131,188, JP-A-59-157638 and JP-A-59-170840. Further, preferred couplers which release fogging agents, development accelerators, silver halide solvents and the like by oxidation-reduction reaction with oxidation products of developing agents are described in JP-A-60-107029, JP-A-60-252340, JP-A-1-44940 and JP-A-1-45687.

Other compounds which can be used in the present invention include competitive couplers described in U.S. Pat. No. 4,130,427, multiequivalent couplers described in U.S. Pat. Nos. 4,283,472, 4,338,393 and 4,310,618, DIR redox compound releasing couplers, DIR coupler releasing couplers, DIR coupler releasing redox compounds and DIR redox releasing redox compounds described in JP-A-60-185950 and JP-A-62-24252, couplers which release dyes recoloring after elimination described in EP-A-173302 and EP-A-313308, bleach accelerator releasing couplers described in *Research Disclosure,* No. 11449, ibid., No. 24241 and JP-A-61-201247, ligand releasing couplers described in U.S. Pat. No. 4,555,477, leuco dye releasing couplers described in JP-A-63-75747 and fluorescent dye releasing couplers described in U.S. Pat. No. 4,774,181.

The couplers used in the present invention can be incorporated in the photographic materials by various conventional dispersing methods.

Examples of high boiling solvents used in oil-in-water dispersion methods are described in U.S. Pat. No. 2,322,027, etc.

Organic solvents having a boiling point of about 30° C. or more and preferably about 50° C. to about 160° C. may be used as auxiliary solvents. Typical examples thereof include ethyl acetate, butyl acetate, ethyl propionate, methyl ethyl ketone, cyclohexanone, 2-ethoxyethyl acetate and dimethylformamide.

The processes and effects of latex dispersion methods and examples of latexes for impregnation are described in U.S. Pat. No. 4,199,363, West German Patent Application (OLS) Nos. 2,541,274 and 2,541,230.

It is preferred that the color photographic materials according to the present invention contain various preservatives or antifungal agents such as 1,2-benzisothiazoline-3-one, n-butyl p-hydroxybenzoate, phenol, 4-chloro-3,5-dimethylphenol, 2-phenoxyethanol and 2-(4-thiazolyl)benzimidazole described in JP-A-63-257747, JP-A-62-272248 and JP-A-1-80941 and phenetyl alcohol.

The present invention can be applied to various color photographic materials. Typical examples thereof include color negative films for general use or cinematographic use, color reversal films for slides or television, color paper, color positive films and color reversal paper.

Appropriate supports which can be used in the present invention are described, for example, in *Research Disclosure,* No. 17643, page 28, ibid., No. 18716, page 647, right column to page 648, left column, and ibid., No. 307105, page 879.

In the photographic materials according to the present invention, the total film thickness of all hydrophilic colloidal layers on the side having an emulsion layer is preferably 28 μm or less, more preferably 23 μm or less, further preferably 18 μm or less, and particularly preferably 16 μm or less. The film swelling speed $T_{1/2}$ is preferably 30 seconds or less, and more preferably 20 seconds or less. The film thickness means a thickness measured under conditions of 25° C.-55% (RH) (for 2 days), and the film swelling speed $T_{1/2}$ can be measured by methods known in the art. For example, measurement can be made by using a swellometer described in A. Green et al., *Photogr. Sci. Eng.,* Vol.19, No.2, pages 124 to 129. $T_{1/2}$ is defined as a time required to reach ½ of a saturated film thickness, taking 90% of a maximum thickness of a swelled film reached by processing with a color developing solution at 30° C. for 3 minutes and 15 seconds as a saturated film thickness.

The film swelling speed $T_{1/2}$ can be adjusted by adding a hardening agent to gelatin used as a binder or changing the above-mentioned aging conditions after coating. The swelling rate is preferably 150 to 400%. The swelling rate can be calculated according to the equation: (maximum swelled film thickness−film thickness)/film thickness, from the maximum thickness of the swelled film under the above-mentioned conditions.

The photographic material according to the present invention is preferably provided with a hydrophilic colloidal layer (referred to as a back layer) having a total dry film thickness of 2 to 20 μm on the side opposite to a side having an emulsion layer. It is preferred that the back layers contain the above-mentioned light absorbers, filter dyes, ultraviolet absorbers, antistatic agents, hardening agents, binders, plasticizers, lubricants, coating aids and surfactants. The swelling rate of the back layers is preferably 150 to 500%.

The photographic materials according to the present invention can be developed by usual methods described in *Research Disclosure,* No. 17643, pages 28 and 29, ibid., No. 18716, page 651, left column to right column, and ibid., No. 307105, pages 880 and 881.

The silver halide photographic materials according to the present invention exhibit the effect more easily and are effective when they are applied to film units with lenses described in JP-B-2-32615 and JP-B-U-3-39784 (the term "JP-B-U" as used herein means an "examined Japanese utility model publication).

The present invention will be described in more detail by referring to the following Examples, but the present invention is not construed as being limited thereto.

EXAMPLE 1

Preparation of Emulsion A

In a reaction vessel kept at 55° C. were placed 40 g of gelatin, 1000 cc of $H_2O$ and 0.6 g of KBr, and thoroughly stirred for dissolution. An aqueous solution containing 100 g of silver nitrate and 500 cc of an aqueous solution containing 69 g of KBr and 2 g of KI were concurrently added thereto for 10 minutes by the so-called controlled double jet method with keeping the silver potential at +60 mV. Just before initiation of addition $1\times10^{-4}$ mol/mol of Ag of thiourea dioxide was added, and just before termination of addition, $9\times10^{-5}$ mol/mol of Ag of sodium thiosulfinate was added thereto. The pH was maintained at 8.5 during addition of silver nitrate, and decreased to 5.0 just after termination of addition.

After usual washing and dispersion stages, the emulsion was subjected to the following chemical sensitization. Sensitizing dye EXS-1 was added in an amount of $3.5\times10^{-4}$ mol/mol of Ag while keeping the temperature of the emulsion at 45° C., and the resulting emulsion was stirred for 10 minutes. Then, the temperature was elevated to 64° C., and the emulsin was subjected to gold/sulfur sensitization. The emulsion thus obtained was composed of tetradecahedral grains having a sphere-corresponding diameter of 0.08 μm.

Preparation of Emulsions B to E

Emulsions B to E were prepared in the same manner as with emulsion A with the exception that the silver potential during grain formation was changed to +110 mV, +90 mV, +75 mV and +45 mV, respectively.

Emulsions B, C and D were composed of rounded cubic grains, and emulsion E was composed of tetradecahedral grains.

Preparation of Emulsion F

Emulsion F was obtained in the same manner as with emulsion A with the exception that the temperature during grain formation was changed to 60° C., silver nitrate and the aqueous halogen solution were added for 13 minutes, and the amount of thiourea dioxide added was adjusted so as to give the maximum sensitivity.

Preparation of Emulsions G to J

Emulsions G to J were prepared in the same manner as with emulsion F with the exception that the silver potential during grain formation was changed to +110 mV, +90 mV, +75 mV and +45 mV, respectively.

Preparation of Emulsion K

Emulsion K was obtained in the same manner as with emulsion A with the exception that the temperature during grain formation was changed to 60° C., silver nitrate and the aqueous halogen solution were added for 20 minutes, and the amount of thiourea dioxide added was adjusted so as to give the maximum sensitivity.

Preparation of Emulsions L to O

Emulsions L to O were prepared in the same manner as with emulsion K with the exception that the silver potential during grain formation was changed to +110 mV, +90 mV, +75 mV and +45 mV, respectively.

Preparation of Emulsion P

In a reaction vessel kept at 50° C. were placed 40 g of gelatin, 1000 cc of $H_2O$ and 0.6 g of KBr, and thoroughly stirred for dissolution. An aqueous solution containing 100 g of silver nitrate and 500 cc of an aqueous solution containing 69 g of KBr and 2 g of KI were concurrently added thereto for 10 minutes by the so-called controlled double jet method with keeping the silver potential at +60 mV. Just before initiation of addition, $5\times10^{-3}$ mol/mol of Ag of imidazole compound BI-1 of the present invention and $2\times10^{-4}$ mol/mol of Ag of thiourea dioxide was added, and just before termination of addition, $9\times10^{-5}$ mol/mol of Ag of sodium thiosulfinate was added thereto. The pH was maintained at 8.5 during addition of silver nitrate, and decreased to 5.0 just after termination of addition.

After usual washing and dispersion stages, the emulsion was subjected to the following chemical sensitization. Sensitizing dye EXS-1 was added in an amount of $3.5\times10^{-4}$ mol/mol of Ag while keeping the temperature of the emulsion at 45° C., and the resulting emulsion was stirred for 10 minutes. Then, the temperature was elevated to 64° C., and the emulsin was subjected to gold/sulfur sensitization. The emulsion thus obtained was composed of cubic grains having a sphere-corresponding diameter of 0.08 $\mu$m. Imidazole compound BI-1 was added as an solution thereof in sulfuric acid.

Preparation of Emulsions Q to T

Emulsions Q to T were prepared in the same manner as with emulsion P with the exception that the silver potential during grain formation was changed to +110 mV, +90 mV, +75 mV and +45 mV, respectively.

For emulsions A to T, the conditions of grain formation, the mean grain size and the coefficient of variation in grain size are shown in Table 2.

TABLE 2

Characteristics of Emulsions in Example 1

| Name of Emulsion | During Grain Formation: Silver Potential (mV) | Temperature (°C.) | Imidazole Compound | Mean Grain Size ($\mu$m) | Coefficient of Variation in Grain Size (%) |
|---|---|---|---|---|---|
| A | +60 | 55 | | 0.082 | 0.15 |
| B | +110 | 55 | | 0.085 | 0.14 |
| C | +90 | 55 | | 0.084 | 0.14 |
| D | +75 | 55 | | 0.082 | 0.13 |
| E | +45 | 55 | | 0.081 | 0.12 |
| F | +60 | 60 | | 0.132 | 0.15 |
| G | +110 | 60 | | 0.137 | 0.15 |
| H | +90 | 60 | | 0.134 | 0.15 |
| I | +75 | 60 | | 0.132 | 0.15 |
| J | +45 | 60 | | 0.131 | 0.15 |
| K | +60 | 60 | | 0.233 | 0.15 |
| L | +110 | 60 | | 0.238 | 0.15 |
| M | +90 | 60 | | 0.234 | 0.15 |
| N | +75 | 60 | | 0.233 | 0.15 |
| O | +45 | 60 | | 0.231 | 0.15 |
| P | +60 | 50 | Added | 0.082 | 0.13 |
| Q | +110 | 50 | Added | 0.083 | 0.13 |
| R | +90 | 50 | Added | 0.083 | 0.13 |
| S | +75 | 50 | Added | 0.083 | 0.13 |
| T | +45 | 50 | Added | 0.081 | 0.13 |

Each of emulsions A to T was applied to a cellulose triacetate support according to the following formulations.

| | | |
|---|---|---|
| (Emulsion Layer) | | |
| Emulsion | the amount of silver coated | 0.78 |
| Gelatin | | 3.42 |
| EXC-1 | | 0.36 |
| EXC-2 | | 0.26 |
| EXC-3 | | 0.06 |
| EXC-4 | | 0.06 |
| EXC-5 | | 0.02 |
| Solv-1 | | 0.68 |
| (Protective Layer) | | |
| Gelatin | | 1.37 |
| B-1 | | 0.006 |
| B-2 | | 0.006 |
| B-3 | | 0.05 |
| H-1 | | 0.33 |

The amounts coated are indicated in g/m$^2$ of silver for silver halides, and indicated in g/m$^2$ for gelatin, couplers and other additives.

Emulsions A to T were each applied to the supports to obtain samples 101 to 120.

Samples 101 to 120 were stored at a temperature of 40° C. at a humidity of 70% for 16 hours, and then, subjected to wedge exposure, followed by processing according to the following method:

| Processing Stage | Temperature (°C.) | Time |
|---|---|---|
| (1) Prebath | 27 ± 1 | 10 sec |
| (2) Removal of Backing and Spray Washing | 27–38 | 5 sec |
| (3) Color Development | 41.1 ± 0.1 | 3 min |
| (4) Stop | 27–38 | 30 sec |
| (5) Bleach Acceleration | 27 ± 1 | 30 sec |
| (6) Bleaching | 27 ± 1 | 3 min |
| (7) Washing | 27–38 | 1 min |
| (8) Fixing | 38 ± 1 | 2 min |
| (9) Washing | 27–38 | 2 min |
| (10) Stabilization | 27–38 | 10 sec |
| (11) Drying | 32–43 | 6 min |

Formulations of processing solutions used in the respective processing stages are as follows:

Formulations of Respective Processing Solutions

| | |
|---|---|
| (1) Prebath | |
| Water at 27 to 38° C. | 800 ml |
| Borax (Decahydrate) | 20.0 g |
| Sodium Sulfate (Anhydride) | 100 g |
| Sodium Hydroxide | 1.0 g |
| Water to make | 1.00 liter |
| pH (27° C.) | 9.25 ± 0.1 |
| (3) Color Developing Solution | |
| Water at 21 to 38° C. | 850 ml |
| Kodak Anticalcium No. 4 | 2.0 ml |
| Sodium Sulfite (Anhydride) | 2.0 g |
| Eastman Antifog No. 9 | 0.22 g |
| Sodium Bromide (Anhydride) | 1.20 g |
| Sodium Carbonate (Anhydride) | 25.6 g |
| Sodium Bicarbonate | 2.7 g |
| Color Developing Agent; 4-[N-Ethyl-N-(β-methanesulfonamidoethyl)]-n-toluidine | 4.0 g |
| Water to make | 1.00 liter |
| pH (27° C.) | 10.20 ± 0.05 |

-continued

| | |
|---|---|
| (4) Stop Solution | |
| Water at 21 to 38° C. | 900 ml |
| 7.0 N Sulfuric Acid | 50 ml |
| Water to make | 1.00 liter |
| pH (27° C.) | 0.8–1.5 |
| (5) Bleach Accelerating Solution | |
| Water at 24 to 38° C. | 900 ml |
| Sodium Metabisulfite (Anhydride) | 10.0 g |
| Glacial Acetic Acid | 25.0 ml |
| Sodium Acetate | 10.0 g |
| EDTA-4Na | 0.7 g |
| PBA | 5.5 g |
| Water to make | 1.00 liter |

-continued

| | |
|---|---|
| pH (27° C.) | 2.3 ± 0.2 |
| (PBA: 2-dimethylaminoethylthiourea dihydrochlorate) | |
| (6) Blieachig Solution | |
| Water at 24 to 38° C. | 900 ml |
| Gelatin | 0.5 g |
| Sodium Persulfate | 33.0 g |
| Sodium Chloride | 15.0 g |
| Sodium primary phosphate (Anhydride) | 9.0 g |
| Phosphoric Acid (85%) | 2.5 ml |
| Water to make | 1.00 liter |
| (8) Fixing Solution | |
| Water at 20 to 38° C. | 700 ml |
| Kodak Anticalcium No. 4 | 2.0 ml |
| 58% Ammonium Thiosulfate Solution | 185 ml |
| Sodium Sulfite (Anhydride) | 10.0 g |
| Phosphoric Acid (85%) | 8.4 g |
| Water to make | 1.00 liter |
| pH (27° C.) | 6.5 ± 0.2 |
| (10) Stabilizing Solution | |
| Water at 21 to 38° C. | 1.00 liter |
| Kodak Stabilizer Additive | 0.14 ml |
| Formalin (37.5% Solution) | 1.50 ml |

After processing, the density was measured through an R filter. The fog and the sensitivity were determined, and summarized in Table 3. The sensitivity was defined as the reciprocal of an exposure amount required to give a density of fog+0.1, and represented by a relative value to the value of sample 101 which was taken as 100. Further, variation in photographic sensitivity with silver potential were represented by relative values to the value of the sample prepared at 60 mV for each emulsion group prepared changing the silver potential which was taken as 100.

As is shown in Table 3, the grains having a mean grain size of 0.15 μm or less cause significantly wide variation in photographic characteristics with changes in silver potential during grain formation. However, the existence of the imidazole compounds can exceedingly decreases this variation.

TABLE 3

Results of Example 1

| Sample No. | Name of Emulsion | Silver Potential during Grain Formation (mV) | Imidazole Compound | Mean Grain Size (μm) | Sensitivity | Variation in Sensitivity |
|---|---|---|---|---|---|---|
| 101 | A | +60 | | 0.082 | 100 | 100 |
| 102 | B | +110 | | 0.085 | 158 | 158 |
| 103 | C | +90 | | 0.084 | 149 | 149 |
| 104 | D | +75 | | 0.082 | 115 | 115 |
| 105 | E | +45 | | 0.081 | 79 | 79 |
| 106 | F | +60 | | 0.132 | 426 | 100 |
| 107 | G | +110 | | 0.137 | 601 | 141 |
| 108 | H | +90 | | 0.134 | 536 | 126 |
| 109 | I | +75 | | 0.132 | 478 | 112 |
| 110 | J | +45 | | 0.131 | 336 | 79 |
| 111 | K | +60 | | 0.233 | 2376 | 100 |
| 112 | L | +110 | | 0.238 | 2666 | 112 |
| 113 | M | +90 | | 0.234 | 2546 | 107 |
| 114 | N | +75 | | 0.233 | 2488 | 105 |
| 115 | O | +45 | | 0.231 | 2117 | 89 |
| 116 | P | +60 | Added | 0.082 | 123 | 100 |
| 117 | Q | +110 | Added | 0.083 | 141 | 115 |
| 118 | R | +90 | Added | 0.083 | 132 | 107 |
| 119 | S | +75 | Added | 0.083 | 129 | 105 |
| 120 | T | +45 | Added | 0.081 | 112 | 91 |

As is shown in Table 3, the grains having a mean grain size of 0.15 μm or less cause wide variation in photographic characteristics with changes in silver potential during grain formation, compared with the grains having a mean grain size of more than 0.15 μm. However, the existence of the imidazole compounds can exceedingly decreases this variation.

EXAMPLE 2

Radical scavenger A-4 of the present invention was added in an amount of $1\times10^{-4}$ mol/mol of Ag to each of emulsions A to T prepared in Example 1 to prepare emulsions A' to T'.

Emulsions A' to T' were applied in the same manner as with Example 1 to prepare samples 121 to 140.

Samples 101 to 140 were stored at a temperature of 40° C. at a humidity of 70% for 16 hours in the same manner as with Example 1, and then, subjected to wedge exposure, followed by development processing in the same manner as with Example 1. The characteristics obtained thereby are referred to as "characteristics after storage".

After measurement of the density of each sample through an R filter, the sensitivity having the same meaning as given in Example 1 was determined for fresh characteristics and the characteristics after storage. Results thereof are shown as fresh sensitivity and sensitivity after storage in Table 4. Both were represented by relative values to the value of sample 101 which was taken as 100.

A value of sensitivity after storage divided by a value of fresh sensitivity is defined as the degree of sensitization, and shown as a measure of keeping durability in Table 4 (the larger the numerical value, the higher the degree of sensitization).

The results shown in Table 4 reveals that the use of the grains having a grain size of 0.15 $\mu$m or less results in an increase in the degree of sensitization and raises a problem with regard to keeping durability. The emulsions produced in the presence of the imidazole compound reduce the degree of sensitization. The emulsions to which the radical scavenger was added further extremely reduce the degree of sensitization to give very excellent keeping durability.

TABLE 4

Results of Example 2

| Sample No. | Name of Emulsion | Radical Scavenger | Fresh Sensitivity | Sensitivity after Storage | Degree of Sensitization | Remarks |
|---|---|---|---|---|---|---|
| 101 | A | | 100 | 142 | 1.42 | Comparison |
| 102 | B | | 158 | 218 | 1.38 | Comparison |
| 103 | C | | 149 | 209 | 1.40 | Comparison |
| 104 | D | | 115 | 161 | 1.40 | Comparison |
| 105 | E | | 79 | 115 | 1.45 | Comparison |
| 106 | F | | 426 | 562 | 1.32 | Comparison |
| 107 | G | | 601 | 793 | 1.32 | Comparison |
| 108 | H | | 536 | 697 | 1.30 | Comparison |
| 109 | I | | 476 | 619 | 1.30 | Comparison |
| 110 | J | | 336 | 447 | 1.33 | Comparison |
| 111 | K | | 2376 | 2614 | 1.10 | Comparison |
| 112 | L | | 2666 | 2879 | 1.08 | Comparison |
| 113 | M | | 2546 | 2775 | 1.09 | Comparison |
| 114 | N | | 2488 | 2737 | 1.10 | Comparison |
| 115 | O | | 2117 | 2329 | 1.10 | Comparison |
| 116 | P | | 123 | 145 | 1.18 | Invention |
| 117 | Q | | 141 | 166 | 1.18 | Invention |
| 118 | R | | 132 | 156 | 1.18 | Invention |
| 119 | S | | 129 | 150 | 1.16 | Invention |
| 120 | T | | 112 | 134 | 1.20 | Invention |
| 121 | A' | Added | 101 | 133 | 1.32 | Invention |
| 122 | B' | Added | 158 | 202 | 1.28 | Invention |
| 123 | C' | Added | 149 | 186 | 1.25 | Invention |
| 124 | D' | Added | 115 | 144 | 1.25 | Invention |
| 125 | E' | Added | 79 | 98 | 1.25 | Invention |
| 126 | F' | Added | 426 | 520 | 1.22 | Invention |
| 127 | G' | Added | 603 | 736 | 1.22 | Invention |
| 128 | H' | Added | 536 | 643 | 1.20 | Invention |
| 129 | I' | Added | 476 | 571 | 1.20 | Invention |
| 130 | J' | Added | 336 | 413 | 1.23 | Invention |
| 131 | K' | Added | 2376 | 2732 | 1.15 | Invention |
| 132 | L' | Added | 2670 | 3070 | 1.15 | Invention |
| 133 | M' | Added | 2546 | 2927 | 1.15 | Invention |
| 134 | N' | Added | 2488 | 2861 | 1.15 | Invention |
| 135 | O' | Added | 2117 | 2329 | 1.10 | Invention |
| 136 | P' | Added | 123 | 133 | 1.08 | Invention |
| 137 | Q' | Added | 141 | 152 | 1.08 | Invention |
| 138 | R' | Added | 132 | 143 | 1.08 | Invention |
| 139 | S' | Added | 129 | 137 | 1.06 | Invention |
| 140 | T' | Added | 115 | 124 | 1.08 | Invention |

EXAMPLE 3

Preparation of Emulsion U

In a reaction vessel kept at 50° C. were placed 40 g of gelatin, 1000 cc of $H_2O$ and 0.6 g of KBr, and thoroughly stirred for dissolution. Then, 300 cc of an aqueous solution containing 50 g of silver nitrate and 300 cc of an aqueous solution containing 40 g of KBr were concurrently added thereto for 7 minutes and 30 seconds by the so-called controlled double jet method with keeping the silver potential at +70 mV. Subsequently, $0.71\times10^{-4}$ mol/mol of Ag of thiourea dioxide was added thereto. Then, the pH was adjusted to 6.0. Subsequently, 500 cc of an aqueous solution containing 150 g of silver nitrate and 600 cc of an aqueous solution containing 126 g of KBr and 6.3 g of KI were concurrently added thereto for 17 minutes by the so-called controlled double jet method with keeping the silver potential at +60 mV. Just before termination of addition, $9\times10^{-5}$ mol/mol of Ag of sodium thiosulfinate was added thereto. The pH was decreased to 5.0 just after termination of addition of silver nitrate, and subsequently, 24 g of gelatin dissolved in hot water was added thereto.

After usual washing and dispersion stages, the temperature of the emulsion was elevated to 64° C., and the emulsion was subjected to usual gold/sulfur sensitization at this temperature. Subsequently, sensitizing dye EXS-1 was added in an amount of $1.1\times10^{-3}$ mol/mol of Ag. The emulsion thus obtained was composed of cubic grains having a sphere-corresponding diameter of 0.14 $\mu$m.

Preparation of Emulsions V and W

Emulsions V and W were prepared in the same manner as with emulsion U with the exception that the silver potential during addition at the second stage was changed to +50 mV and +90 mV, respectively.

Preparation of Emulsion X

In a reaction vessel kept at 50° C. were placed 40 g of gelatin, 1000 cc of $H_2O$ and 0.6 g of KBr, and thoroughly stirred for dissolution. Then, 300 cc of an aqueous solution containing 50 g of silver nitrate and 300 cc of an aqueous solution containing 40 g of KBr were concurrently added thereto for 7 minutes and 30 seconds by the so-called controlled double jet method with keeping the silver potential at +70 mV. Subsequently, $2\times10^{-2}$ mol/mol of Ag of the imidazole compound of the present invention and $1\times10^{-4}$ mol/mol of Ag of thiourea dioxide were added thereto. Then, the pH was adjusted to 6.0. Subsequently, 500 cc of an aqueous solution containing 150 g of silver nitrate and 600 cc of an aqueous solution containing 126 g of KBr and 6.3 g of KI were concurrently added thereto for 17 minutes by the so-called controlled double jet method with keeping the silver potential at +60 mV. Just before termination of addition, $9\times10^{-5}$ mol/mol of Ag of sodium thiosulfinate was added thereto. The pH was decreased to 5.0 just after termination of addition of silver nitrate, and subsequently, 24 g of gelatin dissolved in hot water was added thereto.

After usual washing and dispersion stages, the temperature of the emulsion was elevated to 64° C., and the emulsion was subjected to usual gold/sulfur sensitization at this temperature. Subsequently, sensitizing dye EXS-1 was added in an amount of $1.1\times10^{-3}$ mol/mol of Ag. The emulsion thus obtained was composed of cubic grains having a sphere-corresponding diameter of 0.14 $\mu$m.

Preparation of Emulsions Y and Z

Emulsions Y and Z were prepared in the same manner as with emulsion X with the exception that the silver potential during addition at the second stage was changed to +50 mV and +90 mV, respectively.

Radical scavenger A-4 of the present invention was added in an amount of $3\times10^{-3}$ mol/mol of Ag to each of emulsions U to Z to prepare emulsions U' to Z'.

Using emulsions U to Z and emulsions U' to Z', samples 301 to 312 coated in multiple layers were prepared.

Coating of Back Layer

A coating solution having the following composition was applied to a support on the side opposite to a light-sensitive layer to form a back layer. The coating solution was adjusted so as to give a density of 1.0 to white light. A cellulose triacetate film was used as the support.

| (Composition of Coating Solution) | |
|---|---|
| Methyl Methacrylate-Methacrylic Acid Copolymer (copolymerization molar ratio 1:1) | 1.5 parts |
| Cellulose Acetate Hexahydrophthalate (hydroxypropyl group: 4%, methyl group: 15%, acetyl group: 8%, phthalyl group: 36%) | 1.5 parts |
| Acetone | 50 parts |
| Methanol | 25 parts |
| Methyl Cellosolve | 25 parts |
| Colloidal Carbon | 1.2 parts |

The support having the back layer was coated with the following respective compositions in multiple layers to prepare a multilayer color photographic material, sample 301.

For silver halides and colloidal silver, the amounts coated are indicated in g/m$^2$ of silver, and for gelatin, couplers and other additives, the amount coated are indicated in g/m$^2$. For sensitizing dyes, the amounts coated are indicated in mol per mol of silver halide in the same layer.

Materials used in the respective layers are represented as follows:

| | |
|---|---|
| EXS: Sensitizing Dye | EXC: Cyan Coupler |
| EXM: Magenta Coupler | EXY: Yellow Coupler |
| EXF: Dye | Solv: High Boiling Organic Solvent |
| Cpd: Additive | |

The grain shape, the halogen composition, the mean grain size and the coefficient of variation in grain size of the silver halide emulsions used in sample 301 are shown in Table 5.

| First Layer (Light-Insensitive Fine-Grained Emulsion Layer) | |
|---|---|
| Emulsion 1 the amount of silver coated | 0.09 |
| Gelatin | 0.91 |
| Cpd-1 | $6.9\times10^{-4}$ |
| **Second Layer (Intermediate Layer)** | |
| Gelatin | 2.24 |
| EXC-5 | 0.02 |
| Solv-2 | 0.01 |
| Solv-1 | 0.01 |
| **Third Layer (Low-Sensitivity Red-Sensitive Emulsion Layer)** | |
| Emulsion 2 the amount of silver coated | 0.39 |
| Gelatin | 1.71 |
| EXS-1 | $2.7\times10^{-4}$ |
| EXC-1 | 0.18 |
| EXC-2 | 0.13 |
| EXC-3 | 0.03 |
| EXC-4 | 0.03 |
| EXC-5 | 0.01 |
| Solv-1 | 0.34 |
| **Fourth Layer (Middle-Sensitivity Red-Sensitive Emulsion Layer)** | |
| Emulsion 3 the amount of silver coated | 0.22 |
| Gelatin | 0.98 |
| EXS-1 | $1.3\times10^{-3}$ |
| EXC-1 | 0.12 |
| EXC-2 | 0.09 |
| EXC-3 | 0.03 |
| EXC-5 | 0.01 |
| Solv-1 | 0.24 |
| **Fifth Layer (High-Sensitivity Red-Sensitive Emulsion Layer)** | |
| Emulsion U (prepared in this example) the amount of silver coated | 0.22 |
| Gelatin | 0.71 |
| EXC-1 | 0.08 |
| EXC-2 | 0.06 |
| EXC-5 | 0.01 |
| Solv-1 | 0.14 |
| **Sixth Layer (Intermediate Layer)** | |
| Gelatin | 0.68 |
| Cpd-2 | 0.14 |
| Solv-1 | 0.07 |
| **Seventh Layer (Low-Sensitivity Green-Sensitive Emulsion Layer)** | |
| Emulsion 4 the amount of silver coated | 0.37 |
| Gelatin | 1.91 |
| EXS-2 | $3.4\times10^{-4}$ |
| EXS-4 | $9.0\times10^{-6}$ |
| EXM-1 | 0.39 |
| EXM-3 | 0.11 |
| Solv-1 | 0.54 |
| **Eighth Layer (Middle-Sensitivity Green-Sensitive Emulsion Layer)** | |
| Emulsion 5 the amount of silver coated | 0.17 |
| Gelatin | 0.46 |

-continued

| | |
|---|---|
| EXS-2 | $1.3 \times 10^{-4}$ |
| EXS-4 | $3.5 \times 10^{-5}$ |
| EXM-1 | 0.09 |
| EXM-2 | 0.03 |
| EXM-3 | 0.02 |
| Solv-1 | 0.15 |
| Ninth Layer (High-Sensitivity Green-Sensitive Emulsion Layer) | |
| Emulsion 6 the amount of silver coated | 0.28 |
| Gelatin | 0.49 |
| EXS-2 | $9.5 \times 10^{-4}$ |
| EXS-4 | $2.5 \times 10^{-5}$ |
| EXM-1 | 0.09 |
| EXM-2 | 0.04 |
| EXM-3 | 0.02 |
| Solv-1 | 0.16 |
| Tenth Layer (Yellow Filter Layer) | |
| Yellow Colloid the amount of silver coated | 0.03 |
| Gelatin | 0.76 |
| Cpd-2 | 0.21 |
| Solv-1 | 0.11 |
| Eleventh Layer (Low-Sensitivity Blue-Sensitive Emulsion Layer) | |
| Emulsion 7 the amount of silver coated | 0.17 |
| EXS-5 | $2.0 \times 10^{-3}$ |
| EXY-1 | 0.59 |
| EXC-1 | 0.01 |
| Twelfth Layer (Middle-Sensitivity Blue-Sensitive Emulsion Layer) | |
| Emulsion 8 the amount of silver coated | 0.20 |
| Gelatin | 0.95 |
| EXS-3 | $1.3 \times 10^{-3}$ |
| EXY-1 | 0.39 |
| EXY-2 | 0.04 |
| EXC-1 | 0.01 |
| Solv-1 | 0.13 |
| Thirteenth Layer (High-Sensitivity Blue-Sensitive Emulsion Layer) | |
| Emulsion 9 the amount of silver coated | 0.35 |
| Gelatin | 0.39 |
| EXS-3 | $1.0 \times 10^{-3}$ |
| EXY-1 | 0.14 |
| EXC-1 | 0.01 |
| Solv-1 | 0.05 |
| Fourteenth Layer (First Protective Layer) | |
| Gelatin | 0.47 |
| Fifteenth Layer (Second Protective Layer) | |
| Emulsion 1 the amount of silver coated | 0.66 |
| Gelatin | 1.37 |
| B-1 | 0.006 |
| B-2 | 0.006 |
| B-3 | 0.05 |
| H-1 | 0.33 |

Further, Cpd-3 to Cpd-9, W-1 to W-5 and B-4 were added to improve keeping quality, processability, pressure resistance, mold proofing, bacteria proofing, antistatic quality and coating quality.

In addition, EXF-1 (0.03 g/m$^2$), EXF-2 (0.08 g/m$^2$) and EXF-3 (0.08 g/m$^2$) can also be added to prevent halation and irradiation.

Furthermore, an iron salt, a gold salt, an iridium salt and a rhodium salt may be contained.

TABLE 5

Emulsions Used in Example 3

| Name of Emulsion | Shape of Grain | Halogen Composition Br/I/Cl (mol %) | Grain Size (μm) | Coefficient of Variation in Grain Diameter (%) |
|---|---|---|---|---|
| 1 | Sphere | 99.0/1.0/0.0 | 0.07 | 0.15 |
| 2 | Cube | 98.0/2.0/0.0 | 0.08 | 0.13 |
| 3 | Cube | 97.4/2.6/0.0 | 0.10 | 0.13 |
| 4 | Cube | 98.0/2.0/0.0 | 0.07 | 0.15 |
| 5 | Cube | 97.4/2.6/0.0 | 0.10 | 0.13 |
| 6 | Cube | 97.4/2.6/0.0 | 0.14 | 0.13 |
| 7 | Cube | 94.8/0.7/4.5 | 0.11 | 0.13 |
| 8 | Cube | 94.8/0.7/4.5 | 0.15 | 0.15 |
| 9 | Cube | 94.8/0.7/4.5 | 0.19 | 0.12 |

Emulsion 1 is composed of light-insensitive fine grains.

The emulsion of the fifth layer of sample 301 was changed to emulsions V to Z and U' to Z' to prepare samples 302 to 312, respectively.

Samples 301 to 312 were stored at a temperature of 40° C. at a humidity of 70% for 16 hours, and then, subjected to wedge exposure. Subsequently, the samples were developed in the same manner as with Examples 1 and 2, and the density thereof was measured through an R filter.

The sensitivity was defined as the reciprocal of an exposure amount required to give a density of fog+0.2, and is shown in Table 6 as a relative value to the value of sample 301 which was taken as 100.

For samples 301 to 312, a value of the sensitivity obtained by development processing after storage at a temperature of 30° C. at a humidity of 50% for 1 week after wedge exposure is divided by a value of the sensitivity obtained without storage, and multiplied by 100. The resulting value is defined as the latent image stability and shown in Table 6. A value nearer to 100 is preferred because of a stable latent image.

The results reveal that the emulsions produced in the presence of the imidazole compound are small in variation in photographic characteristics with variation in silver potential resulting in excellent production stability, and are excellent in latent image stability. The results further reveal that addition of the radical scavenger significantly improves latent image stability.

TABLE 6

Results of Example 3

| Sample No. | Emulsion Name of Fifth Layer | Imidazole | Radical Scavenger | Sensitivity | Stability of Latent Image | Remarks |
|---|---|---|---|---|---|---|
| 301 | U | | | 100 | 68 | Comparison |
| 302 | V | | | 78 | 68 | Comparison |
| 303 | W | | | 115 | 73 | Comparison |
| 304 | X | Added | | 115 | 83 | Invention |
| 305 | Y | Added | | 112 | 85 | Invention |
| 306 | Z | Added | | 117 | 88 | Invention |

TABLE 6-continued

Results of Example 3

| Sample No. | Emulsion Name of Fifth Layer | Imidazole | Radical Scavenger | Sensitivity | Stability of Latent Image | Remarks |
|---|---|---|---|---|---|---|
| 307 | U' | Added | Added | 100 | 75 | Invention |
| 308 | V' | Added | Added | 78 | 70 | Invention |
| 309 | W' | Added | Added | 115 | 78 | Invention |
| 310 | X' | Added | Added | 115 | 95 | Invention |
| 311 | Y' | Added | Added | 115 | 95 | Invention |
| 312 | Z' | Added | Added | 118 | 101 | Invention |

As described above, according to the present invention, the fine emulsions excellent in production stability and keeping durability are obtained.

Structural formulas of the compounds used in the present invention are summarized below:

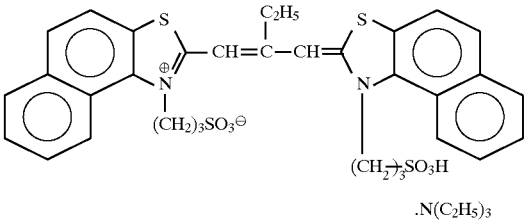

EXS-1

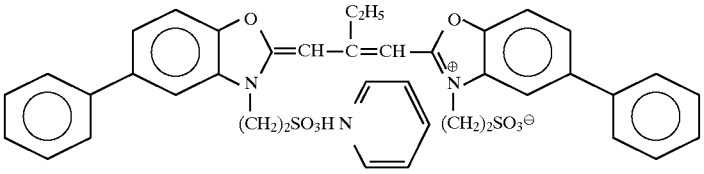

EXS-2

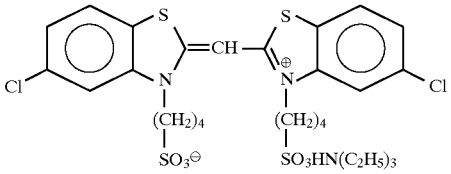

EXS-3

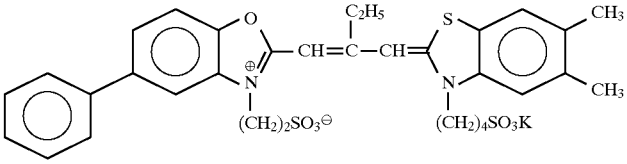

EXS-4

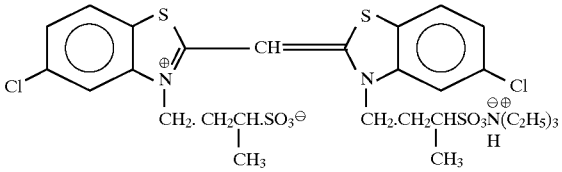

EXS-5

-continued
EXC-1
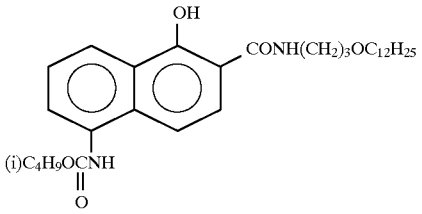
EXC-2
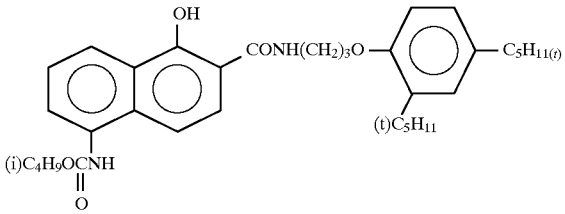
EXC-3
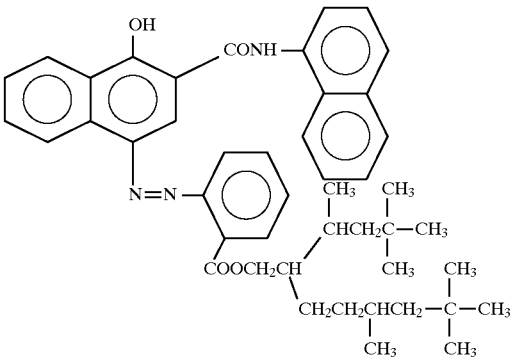
EXC-4
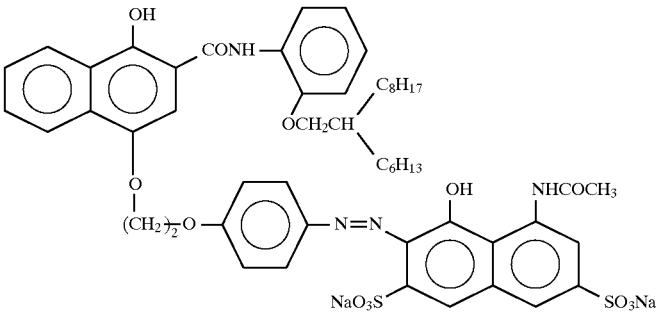
EXC-5
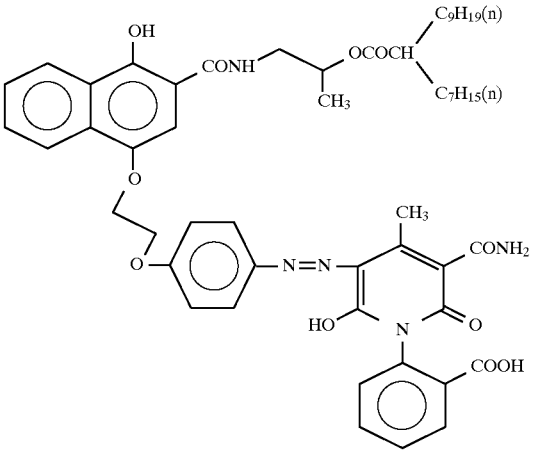

-continued
EXM-1
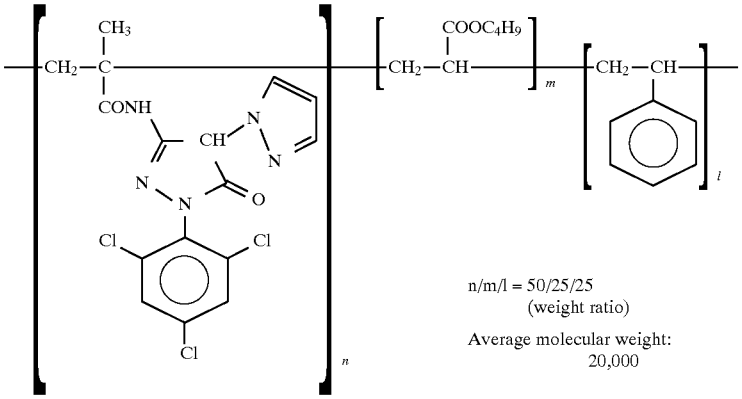
n/m/l = 50/25/25
(weight ratio)
Average molecular weight:
20,000
EXM-2
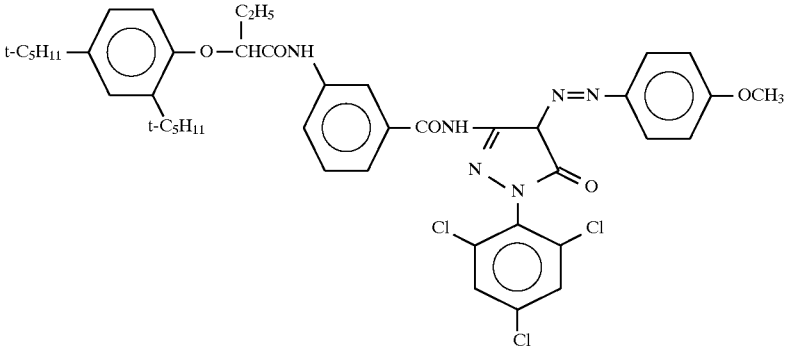
EXM-3
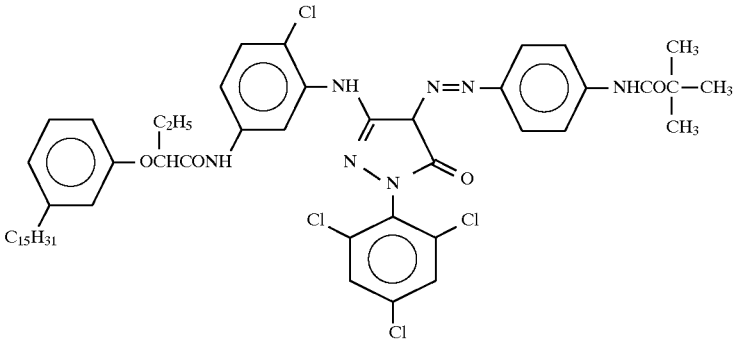
EXY-1
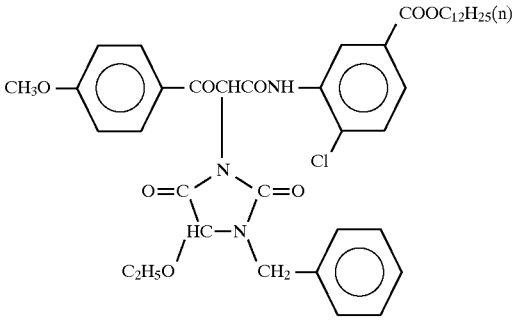

-continued
EXY-2
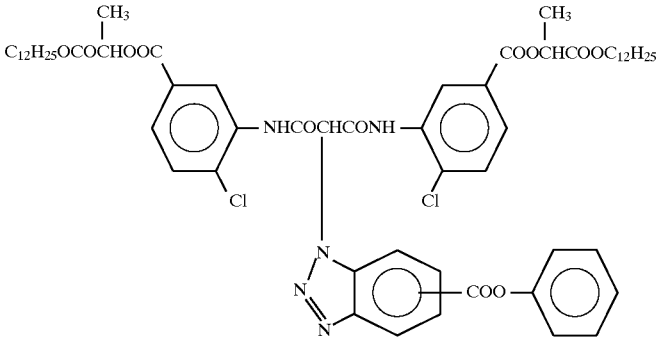
EXF-1
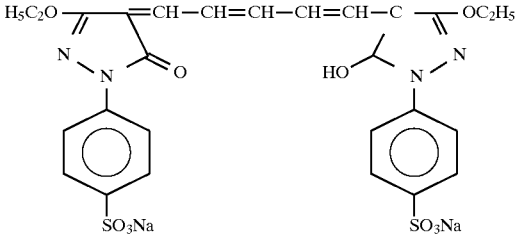
EXF-2
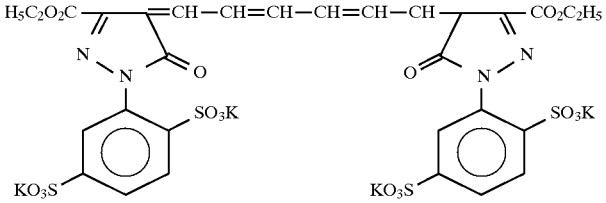
EXF-3
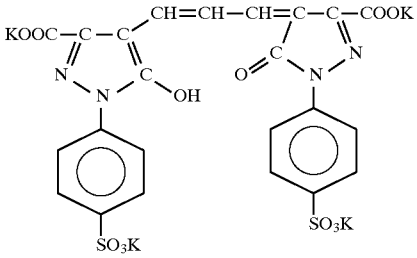
B-1
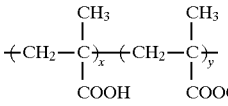
x/y = 10/90
B-2
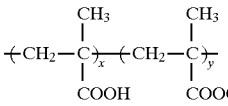
x/y = 40/60
B-3
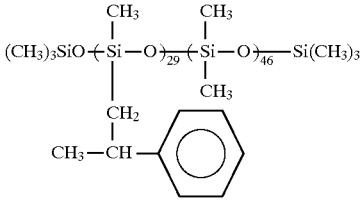
B-4
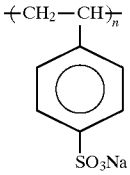

-continued
H-1
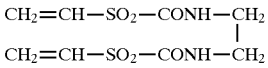
Cpd-1
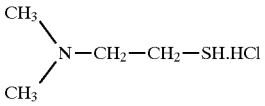
Cpd-2
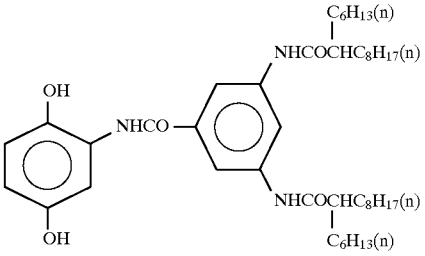
Cpd-3
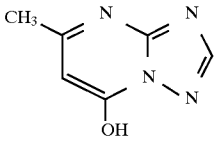
Cpd-4
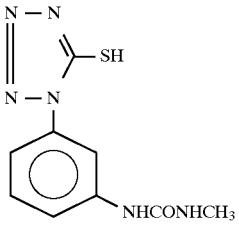
Cpd-5
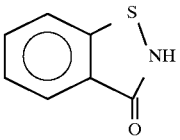
Cpd-6
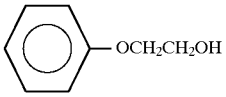
Cpd-7
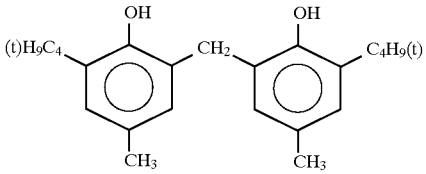
Cpd-8
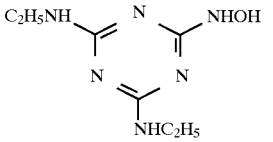
Cpd-9
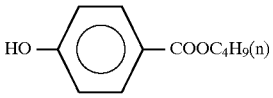

-continued

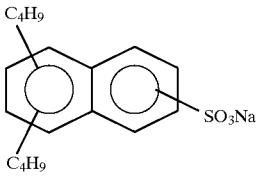

W-1

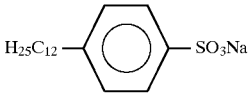

W-2

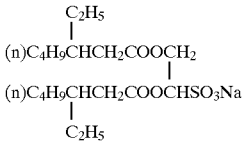

W-3

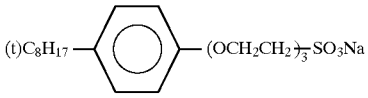

W-4

$C_8F_{17}SO_2N(C_3H_7)CH_2COOK$

W-5

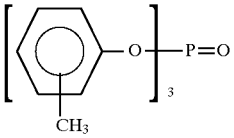

Solv-1

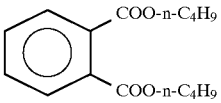

Solv-2

While the invention has been described in detail and with reference to specific examples thereof, it will be apparent to one skilled in the art that various changes and modifications can be made therein without departing from the spirit and scope thereof.

What is claimed is:

1. A method for producing a silver halide emulsion containing silver halide grains having a mean grain size of 0.15 $\mu$m or less, wherein at least a part or the whole of a silver halide grain formation process is performed in the presence of an imidazole compound and at least one radical scavenger is added in said grain formation process.

2. A method as claimed in claim 1, wherein said imidazole compound is used in an amount of from $1\times10^{-5}$ to $1\times10^{-1}$ mol per mol of Ag.

3. A method as claimed in claim 1, wherein said imidazole compound used in said grain formation process is represented by formula (I):

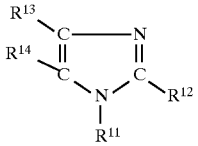

(I)

wherein $R^{11}$, $R^{12}$, $R^{13}$ and $R^{14}$, which may be the same or different, each represents a hydrogen atom, an unsubstituted or substituted alkyl, alkenyl, aryl group or aralkyl, in which a substituent group is at least one group selected from the group consisting of hydroxyl, cyano, alkoxyl, free or esterified carboxyl and sulfo groups.

4. A method as claimed in claim 1, wherein said imidazole compound used in said grain formation process is represented by formula (II):

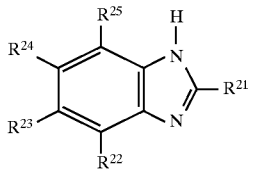

(II)

wherein $R^{21}$ represents a hydrogen atom, a halogen atom, an alkyl group, an alkenyl group, an aryl group or a heterocyclic residue; and $R^{22}$ to $R^{25}$, which may be the same or different, each represents a hydrogen atom, a halogen atom, a hydroxyl group, an amino group, a nitro group, a cyano group, a carboxyl group or a salt thereof, a sulfo group or a salt thereof, an alkyl group, an alkenyl group, an aryl group or an $R^{26}$—D— group, wherein $R^{26}$ represents an alkyl group or an aryl group, and —D— represents —$SO_2$—, —O—, —S—, —CO—, —COO—, —OCO—, —CONH—, —NHCO—, —$SO_2$NH— or —$NHSO_2$—.

5. A method as claimed in claim 1, wherein said imidazole compound used in said grain formation process is represented by formula (III):

$$\text{-}(A)_X\text{-}(B)_Y\text{-} \quad \text{(III)}$$

wherein A represents a repeating unit derived from an ethylenic unsaturated monomer having at least one imidazole group; B represents a repeating unit derived from a monomer other than A; and X and Y represent the percentage by weight of said repeating units represented by A and B, respectively, and X is 0.1 to 100 and Y is 0 to 99.9.

6. A method as claimed in claim 1, wherein said radical scavenger is represented by formula (A):

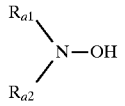

(A)

wherein $R_{a1}$ represents an alkyl group, an alkenyl group, an aryl group, a heterocyclic group, an acyl group, a sulfonyl group, a sulfinyl group, a carbamoyl group, a sulfamoyl group, an alkoxycarbamoyl group, or an aryloxycarbonyl group; and $R_{a2}$ represents a hydrogen atom or the group represented by $R_{a1}$, with the proviso that when $R_{a1}$ is an alkyl group, an alkenyl group or an aryl group, $R_{a2}$ is a heterocyclic group, an acyl group, a sulfonyl group, a sulfinyl group, a carbamoyl group, a sulfamoyl group, an alkoxycarbonyl group or an aryloxycarbonyl group, and $R_{a1}$ and $R_{a2}$ may combine with each other to form a 5-, 6-, or 7-membered ring.

7. A method as claimed in claim 1, wherein said radical scavenger is added in an amount of from $1\times10^{-5}$ to $1\times10^{-2}$ mol per mol of Ag.

8. A method as claimed in claim 1, wherein said silver halide grains have a mean grain size of from 0.04 to 0.15 $\mu$m.

9. A method as claimed in claim 1, wherein said silver halide grains have a silver chloride content of 3 mol % or less.

10. A method as claimed in claim 1, wherein said silver halide grains have a silver iodide content of 0.5 mol % or more and less than 5 mol %.

11. A method as claimed in claim 1, wherein said imidazole compound used in said grain formation process is represented by formula (I):

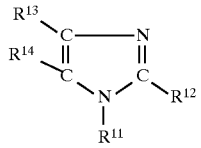

(I)

wherein $R^{11}$, $R^{12}$, $R^{13}$ and $R^{14}$, which may be the same or different, each represents a hydrogen atom, an unsubstituted or substituted alkyl, alkenyl, aryl group or aralkyl, in which a substituent group in at least one group selected from the group consisting of hydroxyl, cyano, alkoxyl, free or esterified carboxyl and sulfo groups.

12. A method as claimed in claim 1, wherein said imidazole compound used in said grain formation process is represented by formula (II):

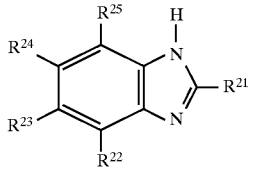

(II)

wherein $R^{21}$ represents a hydrogen atom, a halogen atom, an alkyl group, an alkenyl group, an aryl group or a heterocyclic residue; and $R^{22}$ to $R^{25}$, which may be the same or different, each represents a hydrogen atom, a halogen atom, a hydroxyl group, an amino group, a nitro group, a cyano group, a carboxyl group or a salt thereof, a sulfa group or a salt thereof, an alkyl group, an alkenyl group, an aryl group or an $R^{26}$—D— group, wherein $R^{26}$ represents an alkyl group or an aryl group, and —D— represents —$SO_2$—, —O—, —S—, —CO—, —COO—, —OCO—, —CONH—, —NHCO—, —$SO_2$NH— or —$NHSO_2$—.

13. A method as claimed in claim 1, wherein said imidazole compound used in said grain formation process is represented by formula (III):

$$\left(A\right)_X\left(B\right)_Y \qquad \text{(III)}$$

wherein A represents a repeating unit derived from an ethylenic unsaturated monomer having at least one imidazole group; B represents a repeating unit derived from a monomer other than A; and X and Y represent the percentage by weight of said repeating units represented by A and B, respectively, and X is 0.1 to 100 and Y is 0 to 99.9.

14. The method of claim 1 wherein the silver halide emulsion has a coefficient of 0.20 or less.

15. The method of claim 3 wherein said imidazole is selected from the group consisting of imidazole, 1-methylimidazole, 2-methylimidazole, 1,2-dimethylimidazole, 1-allylimidazole, 1-vinylimidazole, 1-methoxymethylimidazole, 1-(2-carboxyethyl)imidazole, 4-methylimidazole, and 2-methyl-4-methylimidazole.

16. The method of claim 4 wherein said alkyl group has 1–8 carbons, said alkenyl group has 3–8 carbons, said aryl group has 6–12 carbons and said heterocyclic group is a 5- or 6-membered ring.

17. The method of claim 1 wherein said silver halide emulsion grains are predominantly cubic.

* * * * *